US010132257B2

(12) United States Patent
Nakagawa et al.

(10) Patent No.: US 10,132,257 B2
(45) Date of Patent: Nov. 20, 2018

(54) CONTROL SYSTEM OF INTERNAL COMBUSTION ENGINE

(71) Applicant: TOYOTA JIDOSHA KABUSHIKI KAISHA, Toyota-shi, Aichi-ken (JP)

(72) Inventors: Norihisa Nakagawa, Susono (JP); Shuntaro Okazaki, Sunto-gun (JP); Yuji Yamaguchi, Susono (JP)

(73) Assignee: Toyota Jidosha Kabushiki Kaisha, Toyota-shi, Aichi (JP)

( * ) Notice: Subject to any disclaimer, the term of this patent is extended or adjusted under 35 U.S.C. 154(b) by 0 days.

(21) Appl. No.: 15/310,602

(22) PCT Filed: May 15, 2015

(86) PCT No.: PCT/JP2015/002467
§ 371 (c)(1),
(2) Date: Nov. 11, 2016

(87) PCT Pub. No.: WO2015/177996
PCT Pub. Date: Nov. 26, 2015

(65) Prior Publication Data

US 2017/0101950 A1 Apr. 13, 2017

(30) Foreign Application Priority Data

May 23, 2014 (JP) ..... 2014-106874

(51) Int. Cl.
*F02D 41/02* (2006.01)
*F02D 41/14* (2006.01)
*F02D 35/00* (2006.01)

(52) U.S. Cl.
CPC ..... *F02D 41/0295* (2013.01); *F02D 35/0046* (2013.01); *F02D 41/1441* (2013.01); *F02D 41/1475* (2013.01); *F02D 2200/0814* (2013.01)

(58) Field of Classification Search
CPC ..... F02D 35/0046; F02D 41/0052; F02D 41/0295; F02D 41/1441; F02D 41/1475; F02D 2200/0814
See application file for complete search history.

(56) References Cited

U.S. PATENT DOCUMENTS

2002/0020373 A1* 2/2002 Nishimura ..... F02D 21/08 123/90.13
2013/0231845 A1 9/2013 Onoe et al.
2016/0061084 A1 3/2016 Okazaki et al.

FOREIGN PATENT DOCUMENTS

JP 2004-251123 9/2004
JP 2004-285948 10/2004
(Continued)

*Primary Examiner* — Audrey K Bradley
(74) *Attorney, Agent, or Firm* — Finnegan, Henderson, Farabow, Garrett & Dunner, LLP

(57) ABSTRACT

An internal combustion engine includes an exhaust purification catalyst. A control system includes an air-fuel ratio sensor downstream of the exhaust purification catalyst, and an air-fuel ratio control device which controls the air-fuel ratio of the exhaust gas. The target air-fuel ratio is set to a lean air-fuel ratio when output air-fuel ratio of the sensor becomes a rich judged air-fuel ratio or less and is set to a rich air-fuel ratio when output air-fuel ratio becomes a lean judged air-fuel ratio or more. When the engine operating state is a steady operation state and is a low load operation state, at least one of an average lean degree of the target air-fuel ratio while the target air-fuel ratio is set to a lean air-fuel ratio and an average rich degree of the target air-fuel ratio while the target air-fuel ratio is set to a rich air-fuel ratio is increased.

5 Claims, 9 Drawing Sheets

(56) References Cited

FOREIGN PATENT DOCUMENTS

| | | |
|---|---|---|
| JP | 2015-132190 | 7/2015 |
| WO | WO 2012/032631 A1 | 3/2012 |
| WO | WO 2014/118892 A1 | 8/2014 |
| WO | WO 2015/105012 A1 | 7/2015 |

* cited by examiner (A)

(B)

CONTROL SYSTEM OF INTERNAL COMBUSTION ENGINE

CROSS-REFERENCE TO RELATED APPLICATIONS

This application is a national phase application of International Application No. PCT/JP2015/002467, filed May 15, 2015, and claims the priority of Japanese Application No. 2014-106874, filed May 23, 2014, the content of both of which is incorporated herein by reference.

TECHNICAL FIELD

The present invention relates to a control system of an internal combustion engine.

BACKGROUND ART

Widely known in the past has been a control system of an internal combustion engine which provides with an air-fuel ratio sensor in an exhaust passage of the internal combustion engine and controls the amount of fuel, which is fed to the internal combustion engine, based on the output of this air-fuel ratio sensor. In particular, as such a control system, one which provides with an air-fuel ratio sensor at the upstream side in the direction of exhaust flow (below, simply referred to as the "upstream side") of an exhaust purification catalyst provided in the engine exhaust passage and is provided with an oxygen sensor at the downstream side in the direction of exhaust flow (below, simply referred to as the "downstream side") has been known (for example, PTLs 1 and 2).

For example, in the control system described in PTL 1, the target air-fuel ratio of the exhaust gas flowing into the exhaust purification catalyst is alternately switched between a rich air-fuel ratio which is richer than a stoichiometric air-fuel ratio and a lean air-fuel ratio which is leaner than the stoichiometric air-fuel ratio so that the oxygen storage amount of the exhaust purification catalyst alternately fluctuates between a maximum storable oxygen amount and zero. In particular, in the control system described in PTL 1, a rich degree of the rich air-fuel ratio which is alternately switched to is set so as to become larger than a lean degree of the lean air-fuel ratio which is alternately switched to. According to PTL 1, due to this, when making the target air-fuel ratio a lean air-fuel ratio, the lean degree is small, and therefore it is considered possible to keep large torque fluctuation from occurring when setting the target air-fuel ratio to the lean air-fuel ratio.

CITATION LIST

Patent Literature

PTL 1: Japanese Patent Publication No. 2004-285948A
PTL 2: Japanese Patent Publication No. 2004-251123A

SUMMARY OF INVENTION

Technical Problem

In this regard, the oxygen storage capacity of an exhaust purification catalyst is maintained by repeatedly absorbing and releasing oxygen. Therefore, if the exhaust purification catalyst is maintained in a state where oxygen is stored or a state where oxygen is released over a long period of time, the oxygen storage capacity will fall and a drop in the purification performance of the exhaust purification catalyst will be invited. Specifically, for example, the maximum storable oxygen amount of the exhaust purification catalyst will fall. Therefore, to maintain the oxygen storage capacity of the exhaust purification catalyst high, in the same way as the control system described in PTL 1, it is effective to alternately set the target air-fuel ratio of the exhaust gas flowing into the exhaust purification catalyst to a rich air-fuel ratio and a lean air-fuel ratio.

Here, according to the inventors of the present application, it was learned that the oxygen storage capacity of an exhaust purification catalyst is maintained higher, the larger the lean degree (difference from stoichiometric air-fuel ratio) when the target air-fuel ratio is set to a lean air-fuel ratio and the larger the rich degree (difference from stoichiometric air-fuel ratio) when the target air-fuel ratio is set to a rich air-fuel ratio. Therefore, to maintain the oxygen storage capacity of the exhaust purification catalyst high, it is preferable to make the target air-fuel ratio alternate between a lean air-fuel ratio of large lean degree and a rich air-fuel ratio of large rich degree.

On the other hand, if making the rich degree and lean degree of the target air-fuel ratio larger, when exhaust gas containing a large amount of unburned gas or $NO_X$ etc. temporarily flows into the exhaust purification catalyst or when the oxygen storage amount of the exhaust purification catalyst reaches the maximum storable oxygen amount or zero, the amount of unburned gas or $NO_X$ which flows out from the exhaust purification catalyst will become greater.

Therefore, in consideration of the above problem, an object of the present invention is to provide a control system of an internal combustion engine which can keep the amount of unburned gas or $NO_X$ which flows out from the exhaust purification catalyst small while maintaining the purification performance of the exhaust purification catalyst high.

Solution to Problem

To solve this problem, in a first aspect of the invention, there is provided A control system of an internal combustion engine, the engine comprising an exhaust purification catalyst which is arranged in an exhaust passage of the internal combustion engine and which can store oxygen, the control system comprising: a downstream side air-fuel ratio sensor which is arranged at a downstream side of the exhaust purification catalyst in a direction of exhaust flow and which detects an air-fuel ratio of the exhaust gas flowing out from the exhaust purification catalyst; and an air-fuel ratio control device which controls the air-fuel ratio of the exhaust gas so that the air-fuel ratio of the exhaust gas flowing into the exhaust purification catalyst becomes a target air-fuel ratio, wherein the target air-fuel ratio is set to a lean air-fuel ratio which is leaner than a stoichiometric air-fuel ratio when an exhaust air-fuel ratio which is detected by the downstream side air-fuel ratio sensor becomes a rich judged air-fuel ratio, which is richer than the stoichiometric air-fuel ratio, or less, and is set to a rich air-fuel ratio which is richer than a stoichiometric air-fuel ratio when an exhaust air-fuel ratio which is detected by the downstream side air-fuel ratio sensor becomes a lean judged air-fuel ratio, which is leaner than the stoichiometric air-fuel ratio, or more; and, when the engine operating state is a steady operation state and is a low load operation state, compared with when the engine operating state is not a steady operation state and is a medium and high load operation state, at least one of an average lean degree of the target air-fuel ratio while the target air-fuel ratio is set to a lean air-fuel ratio, and an average rich degree of the target air-fuel ratio while the target air-fuel ratio is set to a rich air-fuel ratio is increased.

In a second aspect of the invention, there is provided with the first aspect of the invention, wherein, when the engine operating state is a steady operation state and is a low load operation state, compared with when the engine operating state is not a steady operation state and is a medium and high load operation state, at least one of a maximum value of a lean degree of the target air-fuel ratio while the target air-fuel ratio is set to a lean air-fuel ratio, and a maximum value of a rich degree of the target air-fuel ratio while the target air-fuel ratio is set to a rich air-fuel ratio is increased.

In a third aspect of the invention, there is provided with the first or second aspect of the invention, wherein, the target air-fuel ratio is switched to a lean set air-fuel ratio which is leaner than the target air-fuel ratio when an exhaust air-fuel ratio detected by the downstream side air-fuel ratio sensor becomes a rich judged air-fuel ratio or less, the target air-fuel ratio is set to a lean air-fuel ratio with a lean degree smaller than the lean set air-fuel ratio from a lean degree change timing after the target air-fuel ratio is set to the lean set air-fuel ratio and before the exhaust air-fuel ratio detected by the downstream side air-fuel ratio sensor becomes the lean judged air-fuel ratio or more, until the exhaust air-fuel ratio detected by the downstream side air-fuel ratio sensor becomes the lean judged air-fuel ratio or more, the target air-fuel ratio is switched to a rich set air-fuel ratio which is richer than the stoichiometric air-fuel ratio when the exhaust air-fuel ratio detected by the downstream side air-fuel ratio sensor becomes the lean judged air-fuel ratio or more, and the target air-fuel ratio is set to a rich air-fuel ratio with a rich degree smaller than the rich set air-fuel ratio from a rich degree change timing after the target air-fuel ratio is set to the rich set air-fuel ratio and before the exhaust air-fuel ratio detected by the downstream side air-fuel ratio sensor becomes the rich judged air-fuel ratio or less, until the exhaust air-fuel ratio detected by the downstream side air-fuel ratio sensor becomes the rich judged air-fuel ratio or less.

In a fourth aspect of the invention, there is provided with third aspect of the invention, wherein at least one of a lean degree of the lean set air-fuel ratio and a rich degree of the rich set air-fuel ratio is increased when the engine operating state is a steady operation state and is a low load operation state, compared with when the engine operating state is not a steady operation state and is a medium and high load operation state, and at least one of an average rich degree of the target air-fuel ratio after the rich degree change timing and an average lean degree of the target air-fuel ratio after the lean degree change timing is increased when the engine operating state is a steady operation state and is a low load operation state, compared with when the engine operating state is not a steady operation state and is a medium and high load operation state.

In a fifth aspect of the invention, there is provided with the third aspect of the invention, wherein at least one of a lean degree of the lean set air-fuel ratio and a rich degree of the rich set air-fuel ratio is increased when the engine operating state is a steady operation state and is a low load operation state, compared with when the engine operating state is not a steady operation state and is a medium and high load operation state, and the average lean degree of the target air-fuel ratio after the rich degree change timing and the average rich degree of the target air-fuel ratio after the lean degree change timing are not changed between when the engine operating state is a steady operation state and is a low load operation state and when the engine operating state is not a steady operation state and is a medium and high load operation state.

Advantageous Effects of Invention

According to the present invention, a control system of an internal combustion engine which can keep the amount of unburned gas or $NO_X$ which flows out from the exhaust purification catalyst small while maintaining the purification performance of the exhaust purification catalyst high is provided.

DESCRIPTION OF EMBODIMENTS

Figure 1:
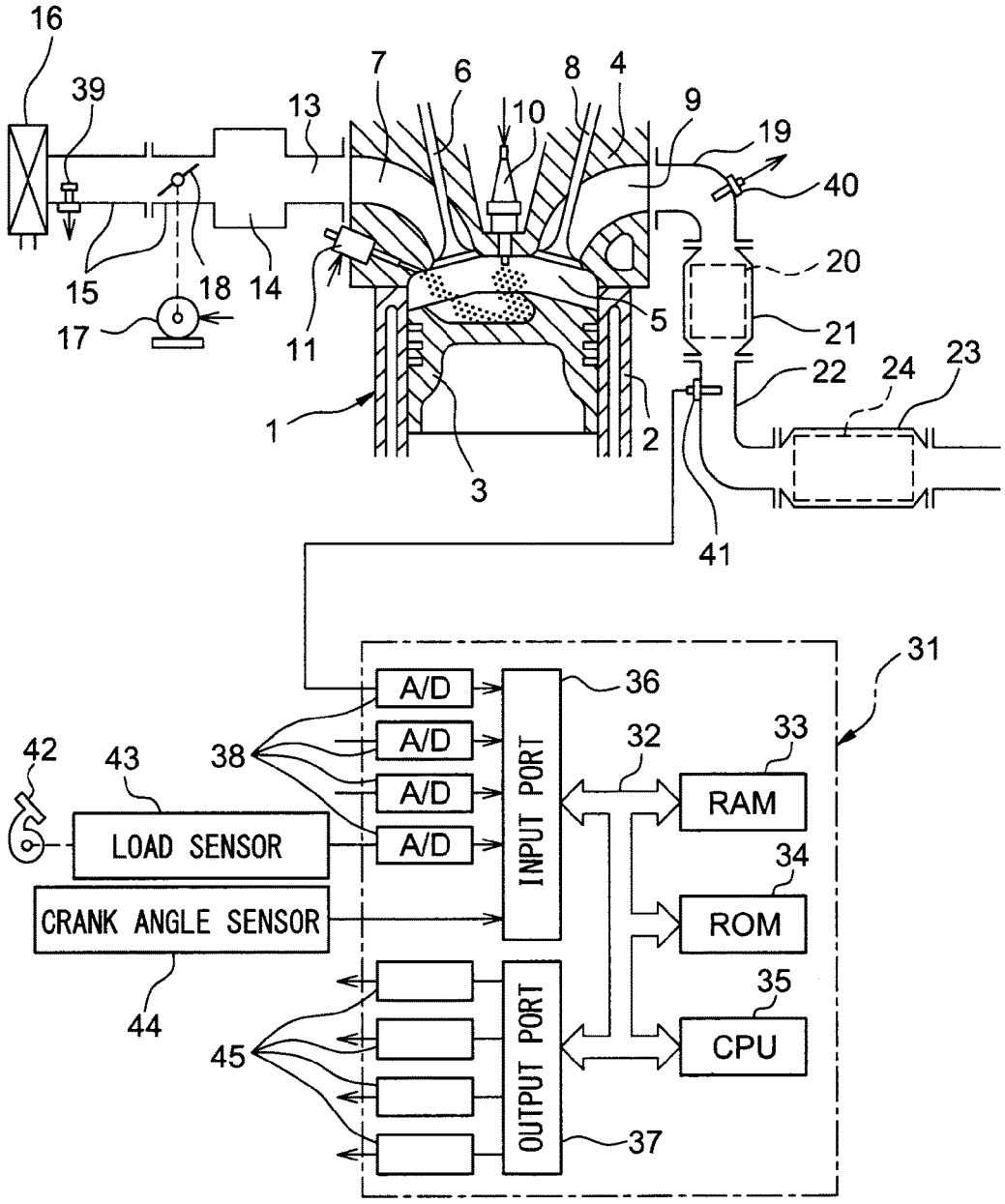
FIG. 1 is a view which schematically shows an internal combustion engine in which a control system of the present invention is used.

Below, referring to the drawings, embodiments of the present invention will be explained in detail. Note that, in the following explanation, similar components are assigned the same reference numerals.

<Explanation of Internal Combustion Engine as a Whole>

FIG. 1 is a view which schematically shows an internal combustion engine in which a control device according to the present invention is used. Referring to FIG. 1, 1 indicates an engine body, 2 a cylinder block, 3 a piston which reciprocates in the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, a spark plug 10 is arranged at a center part of an inside wall surface of the cylinder head 4, while a fuel injector 11 is arranged at a peripheral part of the inner wall surface of the cylinder head 4. The spark plug 10 is configured to generate a spark in accordance with an ignition signal. Further, the fuel injector 11 injects a predetermined amount of fuel into the combustion chamber 5 in accordance with an injection signal. Note that, the fuel injector 11 may also be arranged so as to inject fuel into the intake port 7. Further, in the present embodiment, as the fuel, gasoline with a stoichiometric air-fuel ratio of 14.6 is used. However, the internal combustion engine of the present embodiment may also use another kind of fuel.

The intake port 7 of each cylinder is connected to a surge tank 14 through a corresponding intake runner 13, while the surge tank 14 is connected to an air cleaner 16 through an intake pipe 15. The intake port 7, intake runner 13, surge tank 14, and intake pipe 15 form an intake passage. Further, inside the intake pipe 15, a throttle valve 18 which is driven by a throttle valve drive actuator 17 is arranged. The throttle valve 18 can be operated by the throttle valve drive actuator 17 to thereby change the aperture area of the intake passage.

On the other hand, the exhaust port 9 of each cylinder is connected to an exhaust manifold 19. The exhaust manifold 19 has a plurality of runners which are connected to the exhaust ports 9 and a collected part at which these runners are collected. The collected part of the exhaust manifold 19 is connected to an upstream side casing 21 which houses an upstream side exhaust purification catalyst 20. The upstream side casing 21 is connected through an exhaust pipe 22 to a downstream side casing 23 which houses a downstream side exhaust purification catalyst 24. The exhaust port 9, exhaust manifold 19, upstream side casing 21, exhaust pipe 22, and downstream side casing 23 form an exhaust passage.

The electronic control unit (ECU) 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an airflow meter 39 is arranged for detecting the flow rate of air flowing through the intake pipe 15. The output of this airflow meter 39 is input through a corresponding AD converter 38 to the input port 36. Further, at the collected part of the exhaust manifold 19, an upstream side air-fuel ratio sensor 40 is arranged which detects the air-fuel ratio of the exhaust gas flowing through the inside of the exhaust manifold 19 (that is, the exhaust gas flowing into the upstream side exhaust purification catalyst 20). In addition, in the exhaust pipe 22, a downstream side air-fuel ratio sensor 41 is arranged which detects the air-fuel ratio of the exhaust gas flowing through the inside of the exhaust pipe 22 (that is, the exhaust gas flowing out from the upstream side exhaust purification catalyst 20 and flowing into the downstream side exhaust purification catalyst 24). The outputs of these air-fuel ratio sensors 40 and 41 are also input through the corresponding AD converters 38 to the input port 36.

Further, an accelerator pedal 42 is connected to a load sensor 43 generating an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17. Note that the ECU 31 functions as a control device for controlling the internal combustion engine.

Note that, the internal combustion engine according to the present embodiment is a non-supercharged internal combustion engine which is fueled by gasoline, but the internal combustion engine according to the present invention is not limited to the above configuration. For example, the internal combustion engine according to the present invention may have cylinder array, state of injection of fuel, configuration of intake and exhaust systems, configuration of valve mechanism, presence of supercharger, and/or supercharged state, etc. which are different from the above internal combustion engine.

<Explanation of Exhaust Purification Catalyst>

The upstream side exhaust purification catalyst 20 and downstream side exhaust purification catalyst 24 in each case have similar configurations. The exhaust purification catalysts 20 and 24 are three-way catalysts having oxygen storage abilities. Specifically, the exhaust purification catalysts 20 and 24 are formed such that on substrate consisting of ceramic, a precious metal having a catalytic action (for example, platinum (Pt)) and a substance having an oxygen storage ability (for example, ceria ($CeO_2$)) are carried. The exhaust purification catalysts 20 and 24 exhibit a catalytic action of simultaneously removing unburned gas (HC, CO, etc.) and nitrogen oxides ($NO_X$) and, in addition, an oxygen storage ability, when reaching a predetermined activation temperature.

According to the oxygen storage ability of the exhaust purification catalysts 20 and 24, the exhaust purification catalysts 20 and 24 store the oxygen in the exhaust gas when the air-fuel ratio of the exhaust gas flowing into the exhaust purification catalysts 20 and 24 is leaner than the stoichiometric air-fuel ratio (lean air-fuel ratio). On the other hand, the exhaust purification catalysts 20 and 24 release the oxygen stored in the exhaust purification catalysts 20 and 24 when the air-fuel ratio of the inflowing exhaust gas is richer than the stoichiometric air-fuel ratio (rich air-fuel ratio).

The exhaust purification catalysts 20 and 24 have a catalytic action and oxygen storage ability and thereby have the action of purifying $NO_X$ and unburned gas according to the stored amount of oxygen. That is, in the case where the air-fuel ratio of the exhaust gas flowing into the exhaust purification catalysts 20 and 24 is a lean air-fuel ratio, as shown in FIG. 2A, when the stored amount of oxygen is small, the exhaust purification catalysts 20 and 24 store the oxygen in the exhaust gas. Further, along with this, the $NO_X$ in the exhaust gas is reduced and purified. On the other hand, if the stored amount of oxygen becomes larger beyond a certain stored amount (in the figure, Cuplim) near the maximum storable oxygen amount (upper limit storage amount) Cmax, the exhaust gas flowing out from the exhaust purification catalysts 20 and 24 rapidly rises in concentration of oxygen and $NO_X$.

On the other hand, in the case where the air-fuel ratio of the exhaust gas flowing into the exhaust purification catalysts 20 and 24 is the rich air-fuel ratio, as shown in FIG. 2B, when the stored amount of oxygen is large, the oxygen stored in the exhaust purification catalysts 20 and 24 is released, and the unburned gas in the exhaust gas is oxidized and purified. On the other hand, if the stored amount of oxygen becomes small, the exhaust gas flowing out from the exhaust purification catalysts 20 and 24 rapidly rises in concentration of unburned gas at a certain stored amount (in the figure, Clowlim) near zero (lower limit storage amount).

In the above way, according to the exhaust purification catalysts 20 and 24 used in the present embodiment, the purification characteristics of $NO_X$ and unburned gas in the exhaust gas change depending on the air-fuel ratio and stored amount of oxygen of the exhaust gas flowing into the exhaust purification catalysts 20 and 24. Note that, if having a catalytic action and oxygen storage ability, the exhaust purification catalysts 20 and 24 may also be catalysts different from three-way catalysts.

<Output Characteristic of Air-Fuel Ratio Sensor>

Figure 3:
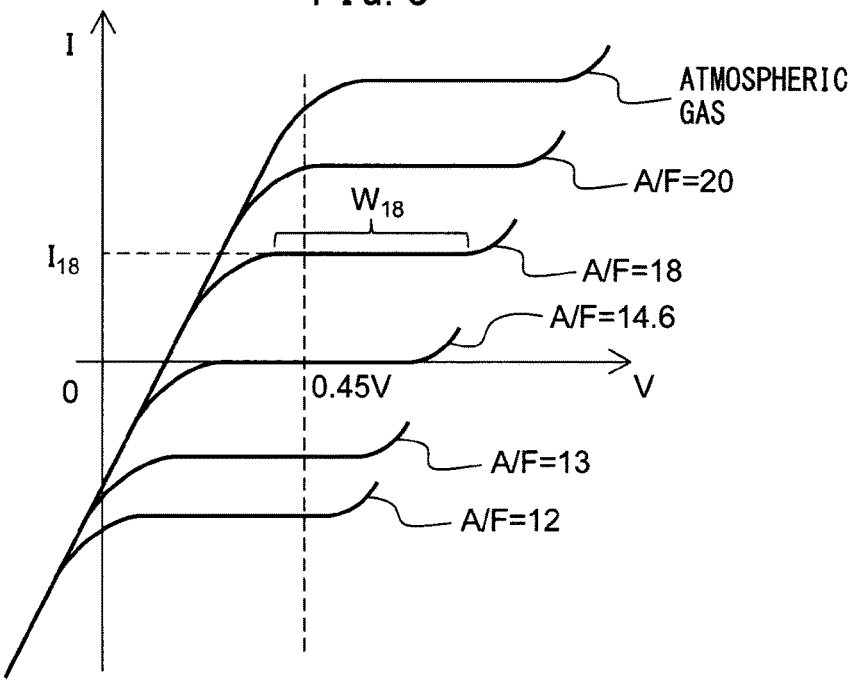
FIG. 3 is a view which shows a relationship between a sensor applied voltage and output current at different exhaust air-fuel ratios.
Figure 4:
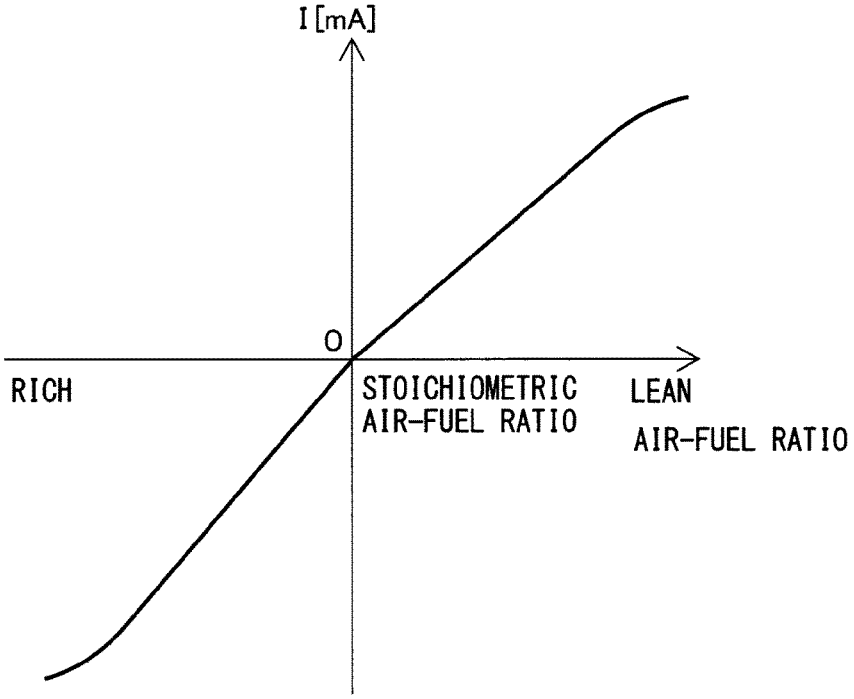
FIG. 4 is a view which shows a relationship between an exhaust air-fuel ratio and output current when making a sensor applied voltage constant.

Next, referring to FIGS. 3 and 4, the output characteristic of air-fuel ratio sensors 40 and 41 in the present embodiment will be explained. FIG. 3 is a view showing the voltage-current (V-I) characteristic of the air-fuel ratio sensors 40 and 41 of the present embodiment. FIG. 4 is a view showing the relationship between air-fuel ratio of the exhaust gas (below, referred to as "exhaust air-fuel ratio") flowing around the air-fuel ratio sensors 40 and 41 and output current I, when making the supplied voltage constant. Note that, in this embodiment, the air-fuel ratio sensor having the same configurations is used as both air-fuel ratio sensors 40 and 41.

As will be understood from FIG. 3, in the air-fuel ratio sensors 40 and 41 of the present embodiment, the output current I becomes larger the higher (the leaner) the exhaust air-fuel ratio. Further, the line V-I of each exhaust air-fuel ratio has a region substantially parallel to the V axis, that is, a region where the output current does not change much at all even if the supplied voltage of the sensor changes. This voltage region is called the "limit current region". The current at this time is called the "limit current". In FIG. 3, the limit current region and limit current when the exhaust air-fuel ratio is 18 are shown by $W_{18}$ and $I_{18}$, respectively. Therefore, the air-fuel ratio sensors 40 and 41 can be referred to as "limit current type air-fuel ratio sensors".

FIG. 4 is a view which shows the relationship between the exhaust air-fuel ratio and the output current I when making the supplied voltage constant at about 0.45V. As will be understood from FIG. 4, in the air-fuel ratio sensors 40 and 41, the output current I varies linearly (proportionally) with respect to the exhaust air-fuel ratio such that the higher (that is, the leaner) the exhaust air-fuel ratio, the greater the output current I from the air-fuel ratio sensors 40 and 41. In addition, the air-fuel ratio sensors 40 and 41 are configured so that the output current I becomes zero when the exhaust air-fuel ratio is the stoichiometric air-fuel ratio. Further, when the exhaust air-fuel ratio becomes larger by a certain extent or more or when it becomes smaller by a certain extent or more, the ratio of change of the output current to the change of the exhaust air-fuel ratio becomes smaller.

Note that, in the above example, as the air-fuel ratio sensors 40 and 41, limit current type air-fuel ratio sensors are used. However, as the air-fuel ratio sensors 40 and 41, it is also possible to use air-fuel ratio sensor not a limit current type or any other air-fuel ratio sensor, as long as the output current varies linearly with respect to the exhaust air-fuel ratio. Further, the air-fuel ratio sensors 40 and 41 may have structures different from each other.

<Summary of Basic Air-Fuel Ratio Control>

Next, air-fuel ratio control in the control system of an internal combustion engine of the present invention will be explained in brief. In the present embodiment, feedback control is performed to control the fuel injection amount from the fuel injector 11, based on the output air-fuel ratio of the upstream side air-fuel ratio sensor 40, so that the output air-fuel ratio of the upstream side air-fuel ratio sensor 40 becomes the target air-fuel ratio. Note that, "output air-fuel ratio" means an air-fuel ratio corresponding to the output value of the air-fuel ratio sensor.

On the other hand, in air-fuel ratio control of the present embodiment, the target air-fuel ratio setting control is performed to set the target air-fuel ratio based on the output air-fuel ratio of the downstream side air-fuel ratio sensor 41, etc. In the target air-fuel ratio setting control, when the output air-fuel ratio of the downstream side air-fuel ratio sensor 41 becomes a rich judged air-fuel ratio which is just slightly richer than the stoichiometric air-fuel ratio (for example, 14.55) or less, it is judged that the air-fuel ratio of the exhaust gas detected by the downstream side air-fuel ratio sensor 41 has become the rich air-fuel ratio. At this time, the target air-fuel ratio is set to a lean set air-fuel ratio. Note that, the "lean set air-fuel ratio" is a predetermined air-fuel ratio which is leaner than the stoichiometric air-fuel ratio (air-fuel ratio serving as center of control) by a certain degree, for example, 14.65 to 20, preferably 14.65 to 18, more preferably 14.65 to 16 or so.

After that, if, in the state where the target air-fuel ratio is set to the lean set air-fuel ratio, the output air-fuel ratio of the downstream side air-fuel ratio sensor 41 becomes an air-fuel ratio which is leaner than a rich judged air-fuel ratio (air-fuel ratio which is closer to stoichiometric air-fuel ratio than rich judged air-fuel ratio), it is judged that the air-fuel ratio of the exhaust gas detected by the downstream side air-fuel ratio sensor 41 has become substantially the stoichiometric air-fuel ratio. At this time, the target air-fuel ratio is set to a weak lean set air-fuel ratio. Note that, the weak lean set air-fuel ratio is a lean air-fuel ratio with a smaller lean degree than the lean set air-fuel ratio (smaller difference from stoichiometric air-fuel ratio), for example, 14.62 to 15.7, preferably 14.63 to 15.2, more preferably 14.65 to 14.9 or so.

On the other hand, when the output air-fuel ratio of the downstream side air-fuel ratio sensor 41 becomes a lean judged air-fuel ratio which is slightly leaner than the stoichiometric air-fuel ratio (for example, 14.65) or more, it is judged that the air-fuel ratio of the exhaust gas detected by the downstream side air-fuel ratio sensor 41 has become the lean air-fuel ratio. At this time, the target air-fuel ratio is set to a rich set air-fuel ratio. Note that, the "rich set air-fuel ratio" is a predetermined air-fuel ratio which is richer by a certain extent from the stoichiometric air-fuel ratio (air-fuel ratio serving as center of control), for example, 10 to 14.55, preferably 12 to 14.52, more preferably 13 to 14.5 or so.

After that, if, in the state where the target air-fuel ratio is set to the rich set air-fuel ratio, the output air-fuel ratio of the downstream side air-fuel ratio sensor 41 becomes an air-fuel ratio which is richer than the lean judged air-fuel ratio (air-fuel ratio which is closer to stoichiometric air-fuel ratio than lean judged air-fuel ratio), it is judged that the air-fuel ratio of the exhaust gas detected by the downstream side air-fuel ratio sensor 41 has become substantially the stoichiometric air-fuel ratio. At this time, the target air-fuel ratio is set to a weak rich set air-fuel ratio. Note that, the "weak rich set air-fuel ratio" is a rich air-fuel ratio with a smaller rich degree than the rich set air-fuel ratio (smaller difference from stoichiometric air-fuel ratio), for example, 13.5 to 14.58, preferably 14 to 14.57, more preferably 14.3 to 14.55 or so.

As a result, in the present embodiment, if the output air-fuel ratio of the downstream side air-fuel ratio sensor 41 becomes the rich judged air-fuel ratio or less, first, the target air-fuel ratio is set to the lean set air-fuel ratio. After that, if the output air-fuel ratio of the downstream side air-fuel ratio sensor 41 becomes larger than the rich judged air-fuel ratio, the target air-fuel ratio is set to the weak lean set air-fuel ratio. On the other hand, if the output air-fuel ratio of the downstream side air-fuel ratio sensor 41 becomes the lean judged air-fuel ratio or more, first, the target air-fuel ratio is set to the rich set air-fuel ratio. After that, if the output air-fuel ratio of the downstream side air-fuel ratio sensor 41 becomes smaller than the lean judged air-fuel ratio, the target air-fuel ratio is set to the weak rich set air-fuel ratio. After that, similar control is repeated.

Note that, the rich judged air-fuel ratio and lean judged air-fuel ratio are set to air-fuel ratios within 1% of the stoichiometric air-fuel ratio, preferably within 0.5%, more preferably within 0.35%. Therefore, the differences from the stoichiometric air-fuel ratio of the rich judged air-fuel ratio and the lean judged air-fuel ratio when the stoichiometric air-fuel ratio is 14.6 are 0.15 or less, preferably 0.073 or less, more preferably 0.051 or less. Further, the difference of the target air-fuel ratio (for example, weak rich set air-fuel ratio or lean set air-fuel ratio) from the stoichiometric air-fuel ratio is set to be larger than the above difference.

<Explanation of Control Using Time Chart>

Figure 5:
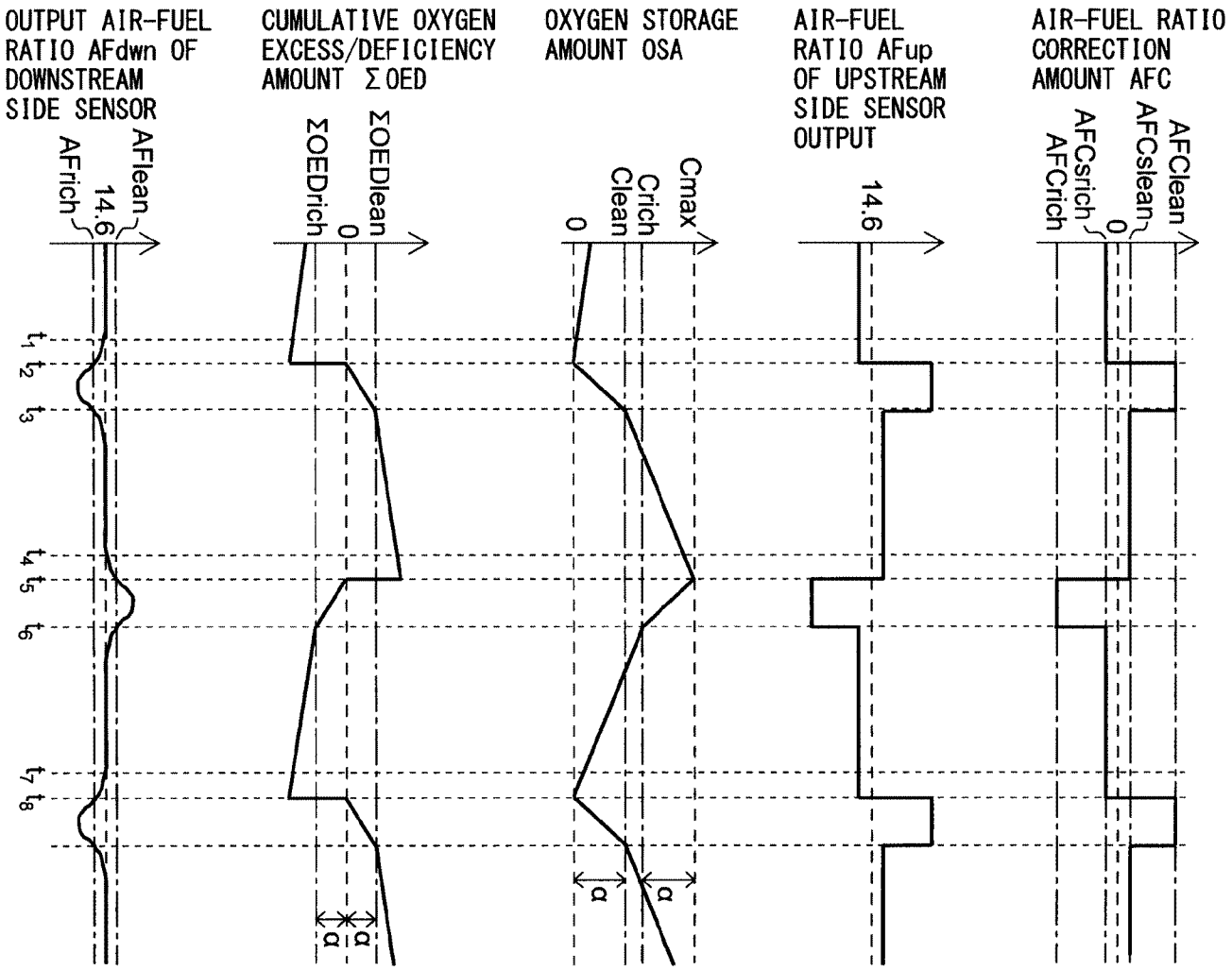
FIG. 5 is a time chart of an air-fuel ratio correction amount, etc., when performing basic air-fuel ratio control by a control system of an internal combustion engine according to the present embodiment.

Referring to FIG. 5, the above-mentioned operation will be explained in detail. FIG. 5 is a time chart of the air-fuel ratio correction amount AFC, the output air-fuel ratio AFup of the upstream side air-fuel ratio sensor 40, the oxygen storage amount OSA of the upstream side exhaust purification catalyst 20, the cumulative oxygen excess/deficiency ΣOED of the exhaust gas flowing into the upstream side exhaust purification catalyst 20, and the output air-fuel ratio AFdwn of the downstream side air-fuel ratio sensor 41, in the case of performing basic air-fuel ratio control by a control system of an internal combustion engine according to the present embodiment.

Note that, the air-fuel ratio correction amount AFC is a correction amount which relates to the target air-fuel ratio of the exhaust gas flowing into the upstream side exhaust purification catalyst 20. When the air-fuel ratio correction amount AFC is 0, the target air-fuel ratio is set to an air-fuel ratio which is equal to the air-fuel ratio serving as center of control (below, the "control center air-fuel ratio") (in the present embodiment, the stoichiometric air-fuel ratio). When the air-fuel ratio correction amount AFC is a positive value, the target air-fuel ratio becomes an air-fuel ratio leaner than the control center air-fuel ratio (in the present embodiment, lean air-fuel ratio), and when the air-fuel ratio correction amount AFC is a negative value, the target air-fuel ratio becomes an air-fuel ratio richer than the control center air-fuel ratio (in the present embodiment, rich air-fuel ratio). Further, the "control center air-fuel ratio" means the air-fuel ratio to which the air-fuel ratio correction amount AFC is added according to the engine operating state, that is, the air-fuel ratio which is the reference when making the target air-fuel ratio vary in accordance with the air-fuel ratio correction amount AFC.

In the illustrated example, in the state before the time $t_1$, the air-fuel ratio correction amount AFC is set to a weak rich set correction amount AFCsrich (corresponding to weak rich set air-fuel ratio). That is, the target air-fuel ratio is set to the rich air-fuel ratio and, along with this, the output air-fuel ratio of the upstream side air-fuel ratio sensor 40 becomes the rich air-fuel ratio. The unburned gas contained in the exhaust gas flowing into the upstream side exhaust purification catalyst 20 is removed by the upstream side exhaust purification catalyst 20. Along with this, the oxygen storage amount OSA of the upstream side exhaust purification catalyst 20 gradually decreases. On the other hand, due to the purification at the upstream side exhaust purification catalyst 20, the exhaust gas flowing out from the upstream side exhaust purification catalyst 20 does not contain unburned gas, and therefore the output air-fuel ratio AFdwn of the downstream side air-fuel ratio sensor 41 becomes substantially the stoichiometric air-fuel ratio.

Figure 2:
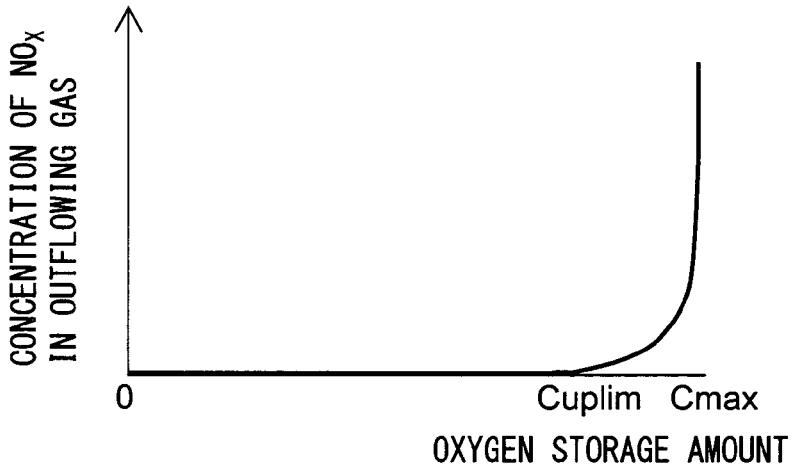
FIG. 2 is a view which shows a relationship between an oxygen storage amount of an exhaust purification catalyst and a concentration of $NO_X$ or concentration of HC and CO in exhaust gas flowing out from the exhaust purification catalyst.
Figure 2:
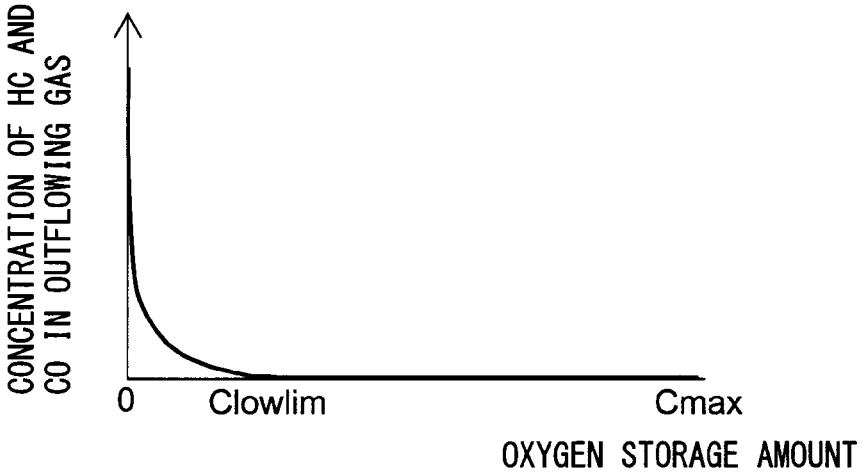

If the oxygen storage amount OSA of the upstream side exhaust purification catalyst 20 gradually decreases, the oxygen storage amount OSA approaches zero at the time $t_1$ (for example, in FIG. 2, Clowlim). Along with this, part of the unburned gas flowing into the upstream side exhaust purification catalyst 20 starts to flow out without being removed by the upstream side exhaust purification catalyst 20. Due to this, after the time $t_1$, the output air-fuel ratio AFdwn of the downstream side air-fuel ratio sensor 41 gradually falls. As a result, in the illustrated example, at the time $t_2$, the oxygen storage amount OSA becomes substantially zero and the output air-fuel ratio AFdwn of the downstream side air-fuel ratio sensor 41 reaches the rich judged air-fuel ratio AFrich.

In the present embodiment, if the output air-fuel ratio AFdwn of the downstream side air-fuel ratio sensor 41 becomes the rich judged air-fuel ratio AFrich or less, the air-fuel ratio correction amount AFC is switched to the lean set correction amount AFClean (corresponding to lean set air-fuel ratio) so as to make the oxygen storage amount OSA increase. Therefore, the target air-fuel ratio is switched from the rich air-fuel ratio to the lean air-fuel ratio.

Note that, in the present embodiment, the air-fuel ratio correction amount AFC is switched not right after the output air-fuel ratio AFdwn of the downstream side air-fuel ratio sensor 41 changes from the stoichiometric air-fuel ratio to the rich air-fuel ratio, but after reaching the rich judged air-fuel ratio AFrich. This is because even if the oxygen storage amount OSA of the upstream side exhaust purification catalyst 20 is sufficient, sometimes the air-fuel ratio of the exhaust gas flowing out from the upstream side exhaust purification catalyst 20 shifts slightly from the stoichiometric air-fuel ratio. Conversely speaking, the rich judged air-fuel ratio is made an air-fuel ratio which the air-fuel ratio of the exhaust gas flowing out from the upstream side exhaust purification catalyst 20 will never reach when the oxygen storage amount of the upstream side exhaust purification catalyst 20 is sufficient. Note that, the same can be said for the above-mentioned lean judged air-fuel ratio.

If, at the time $t_2$, the target air-fuel ratio is switched to the lean air-fuel ratio, the air-fuel ratio of the exhaust gas flowing into the upstream side exhaust purification catalyst 20 changes from the rich air-fuel ratio to the lean air-fuel ratio. Further, along with this, the output air-fuel ratio AFup of the upstream side air-fuel ratio sensor 40 becomes a lean air-fuel ratio (in actuality, a delay occurs from when switching the target air-fuel ratio to when the air-fuel ratio of the exhaust gas flowing into the upstream side exhaust purification catalyst 20 changes, but in the illustrated example, for convenience, it is assumed that they change simultaneously). If, at the time $t_2$, the air-fuel ratio of the exhaust gas flowing into the upstream side exhaust purification catalyst 20 changes to the lean air-fuel ratio, the oxygen storage amount OSA of the upstream side exhaust purification catalyst 20 increases.

If, in this way, the oxygen storage amount OSA of the upstream side exhaust purification catalyst 20 increases, the air-fuel ratio of the exhaust gas flowing out from the upstream side exhaust purification catalyst 20 changes toward the stoichiometric air-fuel ratio. In the example shown in FIG. 5, at the time $t_3$, the output air-fuel ratio AFdwn of the downstream side air-fuel ratio sensor 41 becomes a value larger than the rich judged air-fuel ratio AFrich. That is, the output air-fuel ratio AFdwn of the downstream side air-fuel ratio sensor 41 becomes substantially the stoichiometric air-fuel ratio. This means that the oxygen storage amount OSA of the upstream side exhaust purification catalyst 20 becomes greater to a certain extent.

Therefore, in the present embodiment, when the output air-fuel ratio AFdwn of the downstream side air-fuel ratio sensor 41 changes to a value larger than the rich judged air-fuel ratio AFrich, the air-fuel ratio correction amount AFC is switched to a weak lean set correction amount AFCslean (corresponding to weak lean set air-fuel ratio). Therefore, at the time $t_3$, the lean degree of the target air-fuel ratio is decreased. Below, the time $t_3$ is called the "lean degree change timing".

At the lean degree change timing of the time $t_3$, if the air-fuel ratio correction amount AFC is switched to the weak lean set correction amount AFCslean, the lean degree of the exhaust gas flowing into the upstream side exhaust purification catalyst 20 also becomes smaller. Along with this, the output air-fuel ratio AFup of the upstream side air-fuel ratio sensor 40 becomes smaller and the speed of increase of the oxygen storage amount OSA of the upstream side exhaust purification catalyst 20 falls.

After the time $t_3$, the oxygen storage amount OSA of the upstream side exhaust purification catalyst 20 gradually increases, though the speed of increase is slow. If the oxygen storage amount OSA of the upstream side exhaust purification catalyst 20 gradually increases, the oxygen storage amount OSA finally approaches the maximum storable oxygen amount Cmax (for example, Cuplim of FIG. 2). If, at the time $t_4$, the oxygen storage amount OSA approaches the maximum storable oxygen amount Cmax, part of the oxygen flowing into the upstream side exhaust purification catalyst 20 starts to flow out without being stored in the upstream side exhaust purification catalyst 20. Due to this, the output air-fuel ratio AFdwn of the downstream side air-fuel ratio sensor 41 gradually rises. As a result, in the illustrated example, at the time $t_5$, the oxygen storage amount OSA reaches the maximum storable oxygen amount Cmax and the output air-fuel ratio AFdwn of the downstream side air-fuel ratio sensor 41 reaches the lean judged air-fuel ratio AFlean.

In the present embodiment, if the output air-fuel ratio AFdwn of the downstream side air-fuel ratio sensor 41 becomes the lean judged air-fuel ratio AFlean or more, the air-fuel ratio correction amount AFC is switched to the rich set correction amount AFCrich so as to make the oxygen storage amount OSA decrease. Therefore, the target air-fuel ratio is switched from the lean air-fuel ratio to the rich air-fuel ratio.

If, at the time $t_5$, the target air-fuel ratio is switched to the rich air-fuel ratio, the air-fuel ratio of the exhaust gas flowing into the upstream side exhaust purification catalyst 20 changes from the lean air-fuel ratio to the rich air-fuel ratio. Further, along with this, the output air-fuel ratio AFup of the upstream side air-fuel ratio sensor 40 becomes the rich air-fuel ratio (in actuality, a delay occurs from when switching the target air-fuel ratio to when the air-fuel ratio of the exhaust gas flowing into the upstream side exhaust purification catalyst 20 changes, but in the illustrated example, for convenience, it is assumed that they change simultaneously). If, at the time $t_5$, the air-fuel ratio of the exhaust gas flowing into the upstream side exhaust purification catalyst 20 changes to the rich air-fuel ratio, the oxygen storage amount OSA of the upstream side exhaust purification catalyst 20 decreases.

If, in this way, the oxygen storage amount OSA of the upstream side exhaust purification catalyst 20 decreases, the air-fuel ratio of the exhaust gas flowing out from the upstream side exhaust purification catalyst 20 changes toward the stoichiometric air-fuel ratio. In the example shown in FIG. 5, at the time $t_6$, the output air-fuel ratio AFdwn of the downstream side air-fuel ratio sensor 41 becomes a value smaller than the lean judged air-fuel ratio AFlean. That is, the output air-fuel ratio AFdwn of the downstream side air-fuel ratio sensor 41 becomes substantially the stoichiometric air-fuel ratio. This means that the oxygen storage amount OSA of the upstream side exhaust purification catalyst 20 becomes smaller to a certain extent.

Therefore, in the present embodiment, when the output air-fuel ratio AFdwn of the downstream side air-fuel ratio sensor 41 changes to a value smaller than the lean judged air-fuel ratio AFlean, the air-fuel ratio correction amount AFC is switched from the rich set correction amount to a weak rich set correction amount AFCsrich (corresponding to weak rich set air-fuel ratio).

If, at the time $t_6$, the air-fuel ratio correction amount AFC is switched to the weak rich set correction amount AFCsrich, the rich degree of the air-fuel ratio of the exhaust gas flowing into the upstream side exhaust purification catalyst 20 also becomes smaller. Along with this, the output air-fuel ratio AFup of the upstream side air-fuel ratio sensor 40 increases and the speed of decrease of the oxygen storage amount OSA of the upstream side exhaust purification catalyst 20 falls.

After the time $t_6$, the oxygen storage amount OSA of the upstream side exhaust purification catalyst 20 gradually decreases, through the speed of decrease is slow. If the oxygen storage amount OSA of the upstream side exhaust purification catalyst 20 gradually decreases, the oxygen storage amount OSA finally approaches zero at the time $t_7$ in the same way as the time $t_1$ and falls to the Cdwnlim of FIG. 2. Then, at the time $t_8$, in the same way as the time $t_2$, the output air-fuel ratio AFdwn of the downstream side air-fuel ratio sensor 41 reaches the rich judged air-fuel ratio AFrich. Then, an operation similar to the operation from the time $t_1$ to the time $t_6$ is repeated.

<Advantages in Basic Control>

According to the above-mentioned basic air-fuel ratio control, at the time right after the time $t_2$ when the target air-fuel ratio is changed from the rich air-fuel ratio to the lean air-fuel ratio and at the time right after the time $t_5$ when the target air-fuel ratio is changed from the lean air-fuel ratio to the rich air-fuel ratio, the difference from the stoichiometric air-fuel ratio is large (that is, the rich degree or lean degree is large). For this reason, it is possible to make the unburned gas which flowed out from the upstream side exhaust purification catalyst 20 at the time $t_2$ and the $NO_X$ which flowed out from the upstream side exhaust purification catalyst 20 at the time $t_5$ rapidly decrease. Therefore, it is possible to suppress the outflow of the unburned gas and $NO_X$ from the upstream side exhaust purification catalyst 20.

Further, according to the air-fuel ratio control of the present embodiment, at the time $t_2$, the target air-fuel ratio is set to the lean set air-fuel ratio, and then after the outflow of unburned gas from the upstream side exhaust purification catalyst 20 is stopped and the oxygen storage amount OSA of the upstream side exhaust purification catalyst 20 recovers to a certain extent, the target air-fuel ratio is switched to the weak lean set air-fuel ratio at the time $t_3$. By making the rich degree (difference from stoichiometric air-fuel ratio) of the target air-fuel ratio small in this way, even if $NO_X$ flows out from the upstream side exhaust purification catalyst 20, the amount of outflow per unit time can be decreased. In particular, according to the above air-fuel ratio control, although $NO_X$ flows out from the upstream side exhaust purification catalyst 20 at the time $t_5$, it is possible to keep the amount of outflow at this time small.

In addition, according to the air-fuel ratio control of the present embodiment, at the time $t_5$, the target air-fuel ratio is set to the rich set air-fuel ratio, and then after the outflow of $NO_X$ (oxygen) from the upstream side exhaust purification catalyst 20 stops and the oxygen storage amount OSA of the upstream side exhaust purification catalyst 20 decreases by a certain extent, the target air-fuel ratio is switched to the weak rich set air-fuel ratio at the time $t_6$. By making the rich degree of the target air-fuel ratio (difference from stoichiometric air-fuel ratio) smaller in this way, even if unburned gas flows out from the upstream side exhaust purification catalyst 20, it is possible to decrease the amount of outflow per unit time. In particular, according to the above air-fuel ratio control, although unburned gas flows out from the upstream side exhaust purification catalyst 20 at the times $t_2$ and $t_8$, at this time as well, the amount of outflow thereof can be kept small.

Furthermore, in the present embodiment, as the sensor for detecting the air-fuel ratio of the exhaust gas at the downstream side, the air-fuel ratio sensor 41 is used. This air-fuel ratio sensor 41, unlike an oxygen sensor, does not have hysteresis. For this reason, according to the air-fuel ratio sensor 41, which has a high response with respect to the actual exhaust air-fuel ratio, it is possible to quickly detect the outflow of unburned gas and oxygen (and $NO_X$) from the upstream side exhaust purification catalyst 20. Therefore, by this as well, according to the present embodiment, it is possible to suppress the outflow of unburned gas and $NO_X$ (and oxygen) from the upstream side exhaust purification catalyst 20.

Further, in an exhaust purification catalyst which can store oxygen, if maintaining the oxygen storage amount substantially constant, a drop in the oxygen storage capacity will be invited. Therefore, to maintain the oxygen storage capacity as much as possible, at the time of use of the exhaust purification catalyst, it is necessary to make the oxygen storage amount change up and down. According to the air-fuel ratio control according to the present embodiment, the oxygen storage amount OSA of the upstream side exhaust purification catalyst 20 repeatedly changes up and down between near zero and near the maximum storable oxygen amount. For this reason, the oxygen storage amount OSA of the upstream side exhaust purification catalyst 20 can be maintained high as much as possible.

Note that, in the above embodiment, when, at the time $t_3$, the output air-fuel ratio AFdwn of the downstream side air-fuel ratio sensor 41 becomes a value larger than the rich judged air-fuel ratio AFrich, the air-fuel ratio correction amount AFC is switched from the lean set correction amount AFlean to the weak lean set correction amount AFCslean. Further, in the above embodiment, when, at the time $t_6$, the output air-fuel ratio AFdwn of the downstream side air-fuel ratio sensor 41 becomes a value smaller than the lean judged air-fuel ratio AFlean, the air-fuel ratio correction amount AFC is switched from the rich set correction amount AFCrich to the weak rich set correction amount AFCsrich. However, the timings for switching the air-fuel ratio correction amount AFC do not necessarily have to be determined based on the output air-fuel ratio AFdwn of the downstream side air-fuel ratio sensor 41 and may also be determined based on other parameters.

For example, the timings for switching the air-fuel ratio correction amount AFC may also be determined based on the oxygen storage amount OSA of the upstream side exhaust purification catalyst 20. For example, as shown in FIG. 5, when, after the target air-fuel ratio is switched to the lean air-fuel ratio at the time $t_2$, the oxygen storage amount OSA of the upstream side exhaust purification catalyst 20 reaches the predetermined amount $\alpha$, the air-fuel ratio correction amount AFC is switched to the weak lean set correction amount AFCslean. Further, when, after the target air-fuel ratio is switched to the rich air-fuel ratio at the time $t_5$, the oxygen storage amount OSA of the upstream side exhaust purification catalyst 20 is decreased by a predetermined amount $\alpha$, the air-fuel ratio correction amount AFC is switched to the weak rich set correction amount.

In this case, the oxygen storage amount OSA of the upstream side exhaust purification catalyst 20 is estimated based on the cumulative oxygen excess/deficiency of exhaust gas flowing into the upstream side exhaust purification catalyst 20. The "oxygen excess/deficiency" means the oxygen which becomes in excess or the oxygen which becomes deficient (amount of excessive unburned gas, etc.) when trying to make the air-fuel ratio of the exhaust gas flowing into the upstream side exhaust purification catalyst 20 the stoichiometric air-fuel ratio. In particular, when the target air-fuel ratio becomes the lean set air-fuel ratio, the exhaust gas flowing into the upstream side exhaust purification catalyst 20 becomes excessive. This excess oxygen is stored in the upstream side exhaust purification catalyst 20. Therefore, the cumulative value of the oxygen excess/deficiency (below, referred to as "cumulative oxygen excess/deficiency") can be said to express the oxygen storage amount OSA of the upstream side exhaust purification catalyst 20. As shown in FIG. 5, in the present embodiment, the cumulative oxygen excess/deficiency ΣOED is reset to zero when the target air-fuel ratio changes over the stoichiometric air-fuel ratio.

Note that, the oxygen excess/deficiency is calculated based on the output air-fuel ratio AFup of the upstream side air-fuel ratio sensor 40 and the estimated value of the amount of intake air into the combustion chamber 5 which is calculated based on the air flow meter 39, etc., or the amount of feed of fuel from the fuel injector 11, etc. Specifically, the oxygen excess/deficiency OED is, for example, calculated by the following formula (1):

$$OED=0.23\cdot Qi\cdot(AFup-14.6) \quad (1)$$

Here, 0.23 is the oxygen concentration in the air, Qi indicates the fuel injection amount, and AFup indicates the output air-fuel ratio of the upstream side air-fuel ratio sensor 40.

Alternatively, the timing (lean degree change timing) of switching the air-fuel ratio correction amount AFC to the weak lean set correction amount AFCslean may be determined based on the elapsed time or the cumulative amount of intake air, etc., from when switching the target air-fuel ratio to the lean air-fuel ratio (time $t_2$). Similarly, the timing of switching the air-fuel ratio correction amount AFC to the weak rich set correction amount AFCsrich (rich degree change timing) may be determined based on the elapsed time or the cumulative amount of intake air, etc., from when switching the target air-fuel ratio to the rich air-fuel ratio (time $t_5$).

In this way, the rich degree change timing or lean degree change timing is determined based on various parameters. Whatever the case, the lean degree change timing is set to a timing after the target air-fuel ratio is set to the lean set air-fuel ratio and before the output air-fuel ratio AFdwn of the downstream side air-fuel ratio sensor 41 becomes the lean set air-fuel ratio or more. Similarly, the rich degree change timing is set to a timing after the target air-fuel ratio is set to the rich set air-fuel ratio and before the output air-fuel ratio AFdwn of the downstream side air-fuel ratio sensor 41 becomes the rich set air-fuel ratio or less.

Further, in the above embodiment, from the time $t_2$ to the time $t_3$, the air-fuel ratio correction amount AFC is maintained constant at the lean set air-fuel ratio AFClean. However, during this time period, the air-fuel ratio correction amount AFC need not necessarily be maintained constant and, for example, may also change so as to gradually fall (approach the stoichiometric air-fuel ratio). Similarly, in the above embodiment, from the time $t_3$ to the time $t_5$, the air-fuel ratio correction amount AFC is maintained constant at the weak lean set air-fuel ratio AFClean. However, during this time period, the air-fuel ratio correction amount AFC does not necessarily have to be maintained constant. For example, it may also change so as to gradually fall (approach the stoichiometric air-fuel ratio). Further, the same can be said for the times $t_5$ to $t_6$ and the times $t_6$ to $t_8$.

<Problems in Air-Fuel Ratio Control>

In the meantime, in the above-mentioned air-fuel ratio control, the target air-fuel ratio is alternately switched between the rich air-fuel ratio and the lean air-fuel ratio. Further, the rich degree (difference from stoichiometric air-fuel ratio) of the rich set air-fuel ratio and weak rich set air-fuel ratio is kept relatively small. This is so as to keep the concentration of unburned gas in the exhaust gas as low as possible in the case where rapid acceleration, etc., of the vehicle which mounts the internal combustion engine causes the air-fuel ratio of the exhaust gas flowing into the upstream side exhaust purification catalyst 20 to be temporarily disturbed or in the case where the oxygen storage amount OSA of the upstream side exhaust purification catalyst 20 becomes substantially zero and thereby rich air-fuel ratio exhaust gas flows out from the upstream side exhaust purification catalyst 20.

Similarly, the lean degree (difference from stoichiometric air-fuel ratio) of the lean set air-fuel ratio and weak lean set air-fuel ratio is also kept relatively small. This is so as to keep the concentration of $NO_X$ in the exhaust gas as low as possible in the case where rapid deceleration, etc., of the vehicle which mounts the internal combustion engine causes the air-fuel ratio of the exhaust gas flowing into the upstream side exhaust purification catalyst 20 to be temporarily disturbed or in the case where some other reason causes the oxygen storage amount OSA of the upstream side exhaust purification catalyst 20 to reach the maximum storable oxygen amount Cmax and thereby lean air-fuel ratio exhaust gas flows out from the upstream side exhaust purification catalyst 20.

On the other hand, the oxygen storage capacity of the exhaust purification catalyst changes in accordance with the rich degree and lean degree of the air-fuel ratio of the exhaust gas flowing into the exhaust purification catalyst. Specifically, the larger of the rich degree and lean degree of the air-fuel ratio of the exhaust gas flowing into the exhaust purification catalyst enables the amount of oxygen which can be stored in the exhaust purification catalyst to be larger. However, as explained above, from the viewpoint of the unburned gas concentration or $NO_X$ concentration in the exhaust gas flowing out from the upstream side exhaust purification catalyst 20, the rich degree of the rich set air-fuel ratio and weak rich set air-fuel ratio and the lean degree of the lean set air-fuel ratio and weak lean set air-fuel ratio are kept relatively small. For this reason, if performing such control, the oxygen storage capacity of the upstream side exhaust purification catalyst 20 cannot be maintained sufficiently high.

Here, the exhaust gas flowing into the upstream side exhaust purification catalyst 20 becomes temporarily disturbed (outside disturbance) when the engine operating state is not a steady operation state. Conversely speaking, when the engine operating state is a steady operation state, outside disturbance seldom occurs. In addition, the lower the engine load, that is, the lower the load of the engine operating state, the smaller the change in the air-fuel ratio of the exhaust gas flowing into the upstream side exhaust purification catalyst 20 even if temporary disturbance occurs.

For this reason, when the engine operating state is a steady operation state or when the engine operating state is a low load operation state, even if making the rich degree of the rich set air-fuel ratio or the lean degree of the lean set air-fuel ratio larger, there is little possibility of $NO_X$ or unburned gas flowing out from the upstream side exhaust purification catalyst 20. Further, even if $NO_X$ or unburned gas flows out from the upstream side exhaust purification catalyst 20, the amount can be kept low. Note that, "when the engine operating state is a steady operation state" means, for example, when the amount of change per unit time of the engine load of the internal combustion engine is a predetermined amount of change or less or when the amount of change per unit time of the amount of intake air of the internal combustion engine is a predetermined amount of change or less.

<Control for Setting Set Air-Fuel Ratios>

Therefore, in the present embodiment, when the engine operating state is a steady operation state and is a low load operation state, compared with when the engine operating state is not a steady operation state and is a medium and high load operation state, the rich degree when making the target air-fuel ratio the rich air-fuel ratio and the lean degree when making the target air-fuel ratio the lean air-fuel ratio are set larger. Note that, regarding the low load, medium load, and high load in the Description, when dividing the total engine load into three equal parts, the lowest load region is called the "low load", the medium extent load region is called the "medium load", and the highest load region is called the "high load".

Figure 6:
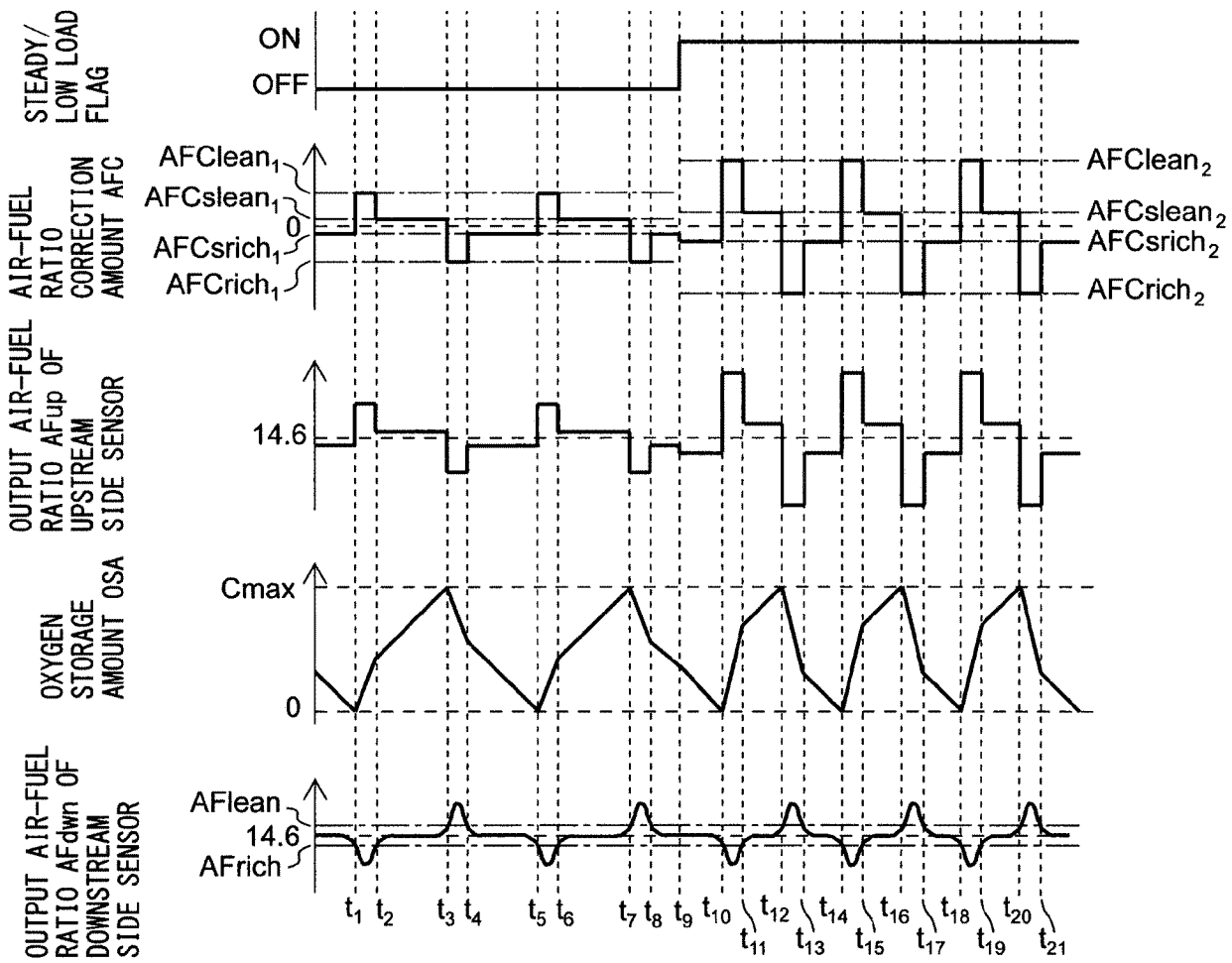
FIG. 6 is a time chart similar to FIG. 5 of an air-fuel ratio correction amount, etc., when performing control for setting different set air-fuel ratios.

FIG. 6 is a time chart similar to FIG. 5 of the target air-fuel ratio, etc., when performing control to set the set air-fuel ratios. In the example shown in FIG. 6, similar control is performed as in the example shown in FIG. 5 up to the time $t_9$. Therefore, when the output air-fuel ratio AFdwn of the downstream side air-fuel ratio sensor 41 becomes the rich judged air-fuel ratio AFrich or less at the times $t_1$ and $t_5$, the air-fuel ratio correction amount AFC is switched to the lean set air-fuel ratio $AFClean_1$ (below, referred to as the "normal lean set air-fuel ratio"). Then, if the output air-fuel ratio AFdwn of the downstream side air-fuel ratio sensor 41 becomes larger than the rich judged air-fuel ratio AFrich at the times $t_2$ and $t_6$, the air-fuel ratio correction amount AFC is switched to the weak lean set air-fuel ratio $AFCslean_1$ (below, referred to as the "normal weak lean set air-fuel ratio").

On the other hand, when the output air-fuel ratio AFdwn of the downstream side air-fuel ratio sensor 41 becomes the lean judged air-fuel ratio AFlean or more at the times $t_3$ and $t_7$, the air-fuel ratio correction amount AFC is switched to the rich set air-fuel ratio $AFCrich_1$ (below, referred to as the "normal rich set air-fuel ratio"). Then, if the output air-fuel ratio AFdwn of the downstream side air-fuel ratio sensor 41 becomes smaller than the lean judged air-fuel ratio AFlean at the times $t_4$ and $t_8$, the air-fuel ratio correction amount AFC is switched to the weak rich set air-fuel ratio $AFCsrich_1$ (below, referred to as "normal weak rich set air-fuel ratio").

Note that, up to the time $t_9$, the engine operating state is a steady operation state and is not a low load operation state. For this reason, the constant low load flag, which is turned on when the engine operating state is a steady operation state and is a low load operation state, is set to OFF.

On the other hand, if, at the time $t_9$, the engine operating state is a steady operation state and is a low load operation state and therefore the constant low load flag is set to ON, the absolute values of the lean set correction amount AFClean, weak lean set correction amount AFCslean, rich set correction amount AFCrich, and weak rich set correction amount AFCsrich (below, these together referred to as the "set correction amounts") are made to increase.

As a result, at the time $t_9$, the air-fuel ratio correction amount AFC is changed from the normal weak rich set correction amount $AFCsrich_1$ to the increased weak rich set correction amount $AFCsrich_2$ with a larger absolute value than the normal weak rich set correction amount $AFCsrich_1$. That is, the target air-fuel ratio is set to the increased rich set air-fuel ratio with a larger rich degree than the normal rich set air-fuel ratio. Therefore, after the time $t_9$, the speed of decrease of the oxygen storage amount OSA of the upstream side exhaust purification catalyst 20 becomes faster.

Then, if, at the time $t_{10}$, the output air-fuel ratio AFdwn of the downstream side air-fuel ratio sensor 41 becomes the rich judged air-fuel ratio AFrich or less, the air-fuel ratio correction amount AFC is switched to the increased lean set correction amount $AFClean_2$ with a larger absolute value than the normal lean set correction amount $AFClean_1$. That is, the target air-fuel ratio is set to the increased weak lean set air-fuel ratio with a larger lean degree than the normal weak lean set air-fuel ratio. Therefore, the speed of increase of the oxygen storage amount OSA of the upstream side exhaust purification catalyst 20 after the time $t_{10}$ becomes faster than the speed of increase during the times $t_1$ to $t_2$ and the times $t_5$ to $t_6$.

If, at the time $t_{11}$, the output air-fuel ratio AFdwn of the downstream side air-fuel ratio sensor 41 becomes larger than the rich judged air-fuel ratio AFrich, the air-fuel ratio correction amount AFC is switched to an increased weak lean set correction amount $AFCslean_2$ with a larger absolute value than the normal weak lean set correction amount $AFCslean_1$. That is, the target air-fuel ratio is set to the increased weak lean set air-fuel ratio with a lean degree larger than the normal weak lean set air-fuel ratio. Therefore, the speed of increase of the oxygen storage amount OSA of the upstream side exhaust purification catalyst 20 after the time $t_{11}$ becomes faster than the speed of increase during times $t_2$ to $t_3$ and the times $t_6$ to $t_7$.

Then, if, at the time $t_{12}$, the output air-fuel ratio AFdwn of the downstream side air-fuel ratio sensor 41 becomes the lean judged air-fuel ratio AFlean or more, the air-fuel ratio correction amount AFC is switched to an increased rich set correction amount $AFCrich_2$ with a larger absolute value than the normal rich set correction amount $AFCrich_1$. That is, the target air-fuel ratio is set to the increased rich set air-fuel ratio with a larger rich degree than the normal rich set air-fuel ratio. Therefore, the speed of decrease of the oxygen storage amount OSA of the upstream side exhaust purification catalyst 20 after the time $t_{12}$ becomes faster than the speed of decrease during the times $t_3$ to $t_4$ and the times $t_7$ to $t_8$.

If, at the time $t_{13}$, the output air-fuel ratio AFdwn of the downstream side air-fuel ratio sensor 41 becomes smaller than the lean judged air-fuel ratio AFlean, the air-fuel ratio correction amount AFC is switched to an increased weak rich set correction amount $AFCsrich_2$ with a larger absolute value than the normal weak rich set correction amount $AFCsrich_1$. That is, the target air-fuel ratio is set to the increased weak rich set air-fuel ratio with a larger rich degree than the normal weak rich set air-fuel ratio. Therefore, the speed of decrease of the oxygen storage amount OSA of the upstream side exhaust purification catalyst 20 after the time $t_{13}$ becomes faster than the speed of decrease during the times $t_r$ to $t_5$ and the times $t_8$ to $t_9$. Then, so long as the engine operating state is a steady operation state and is a low load operation state, the operation during the times $t_{10}$ to $t_{14}$ is repeated.

According to this embodiment, when the engine operating state is a steady operation state and is a low load operation state, the rich degree of the rich set air-fuel ratio and weak rich set air-fuel ratio is set larger and the lean degree of the lean set air-fuel ratio and weak lean set air-fuel ratio is set larger. For this reason, it is possible to keep the outflow of $NO_X$ or unburned gas from the upstream side exhaust purification catalyst 20 as small as possible while maintaining the oxygen storage capacity of the upstream side exhaust purification catalyst 20 higher.

Note that, in the above embodiment, when the engine operating state is in a steady operation state and is a low load operation state, both the rich degree of the rich set air-fuel ratio and weak rich set air-fuel ratio and the lean degree of the lean set air-fuel ratio and weak lean set air-fuel ratio are set larger. However, it is not necessarily required to make both the rich degree and lean degree larger. It is also possible to make either of these rich degree and lean degree increase. In this case, from the viewpoint of making the $NO_X$ flowing out from the upstream side exhaust purification catalyst 20 as small as possible, it is preferable not to make the lean degree of the lean set air-fuel ratio and weak lean set air-fuel ratio increase and to make only the rich degree of the rich set air-fuel ratio and weak rich set air-fuel ratio increase.

Further, in the above embodiment, when the engine operating state is a steady operation state and is a low load operation state, the rich degree and lean degree of the set air-fuel ratio are increased. However, leaving aside when the engine operating state is not a steady operation state and is a medium and high load operation state, it is also possible to make the rich degree and lean degree of the set air-fuel ratio increase at times other than when the engine operating state is a steady operation state and is a low load operation state. For example, it is also possible to make the rich degree and lean degree of the set air-fuel ratio increase when the engine operating state is a steady operation state and is a medium load operation state or medium and high load operation state.

<Explanation of Specific Control>

Figure 7:
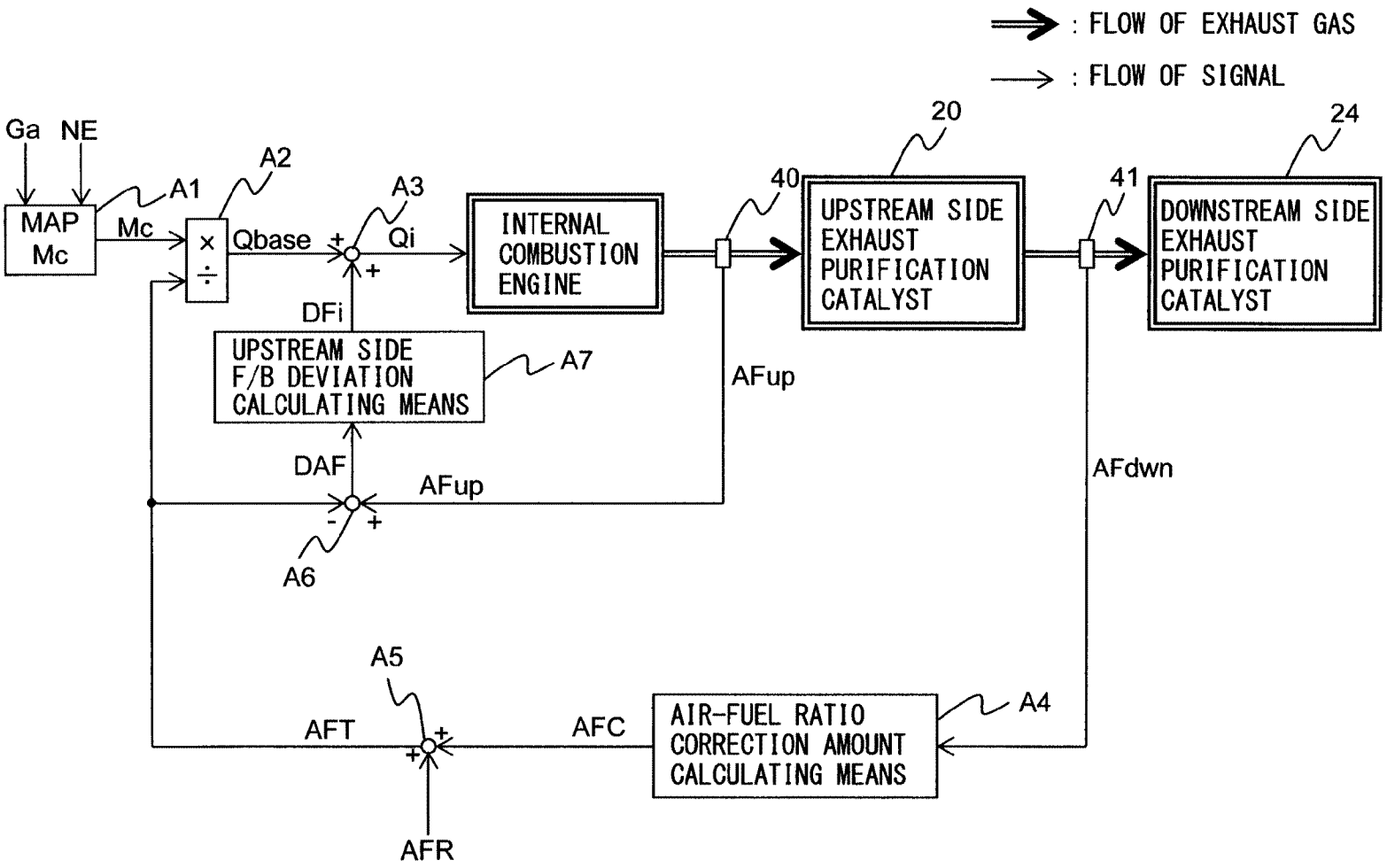
FIG. 7 is a functional block diagram of a control system.
Figure 8:
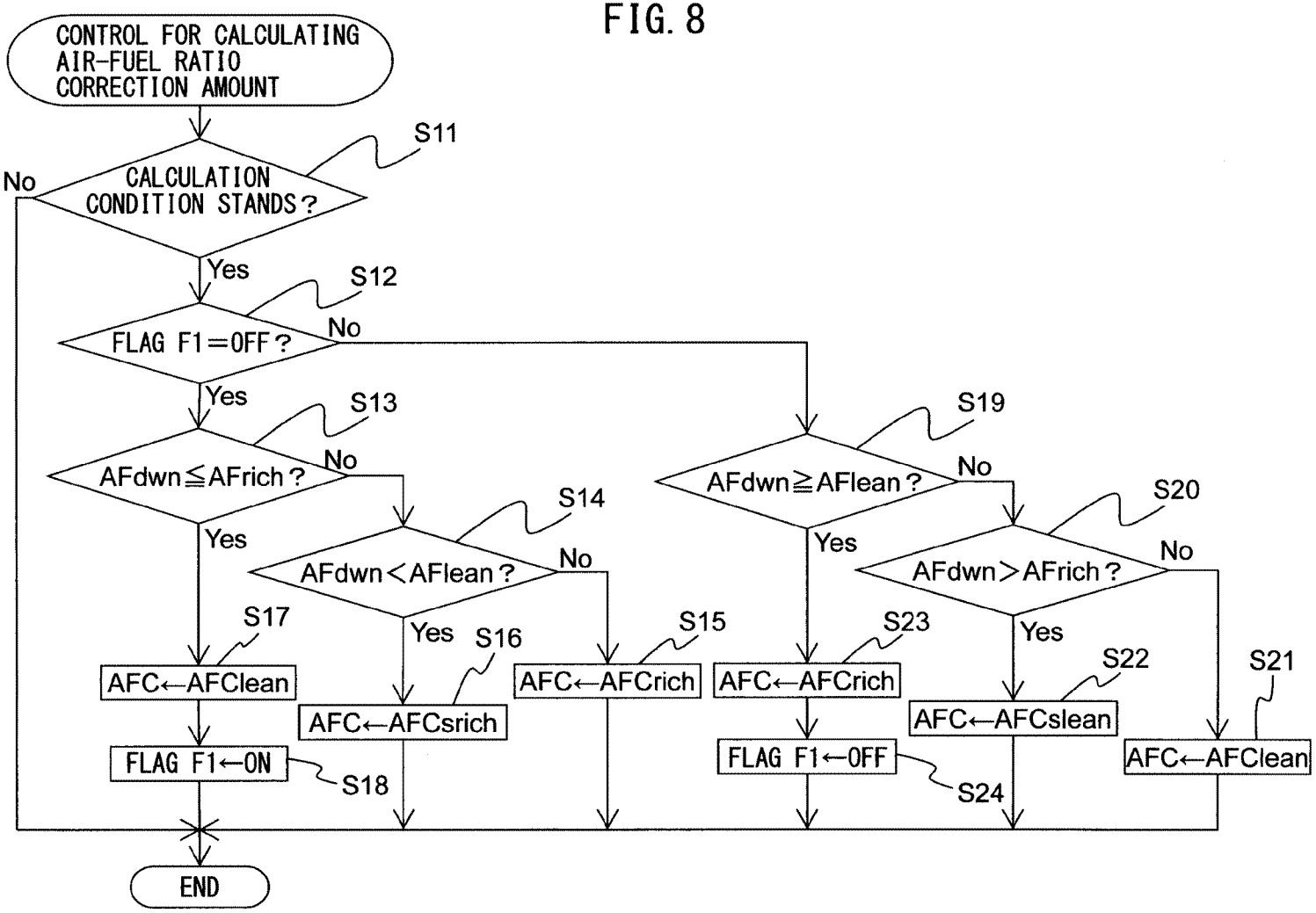
FIG. 8 is a flow chart which shows a control routine in control for calculation of an air-fuel ratio correction amount.
Figure 9:
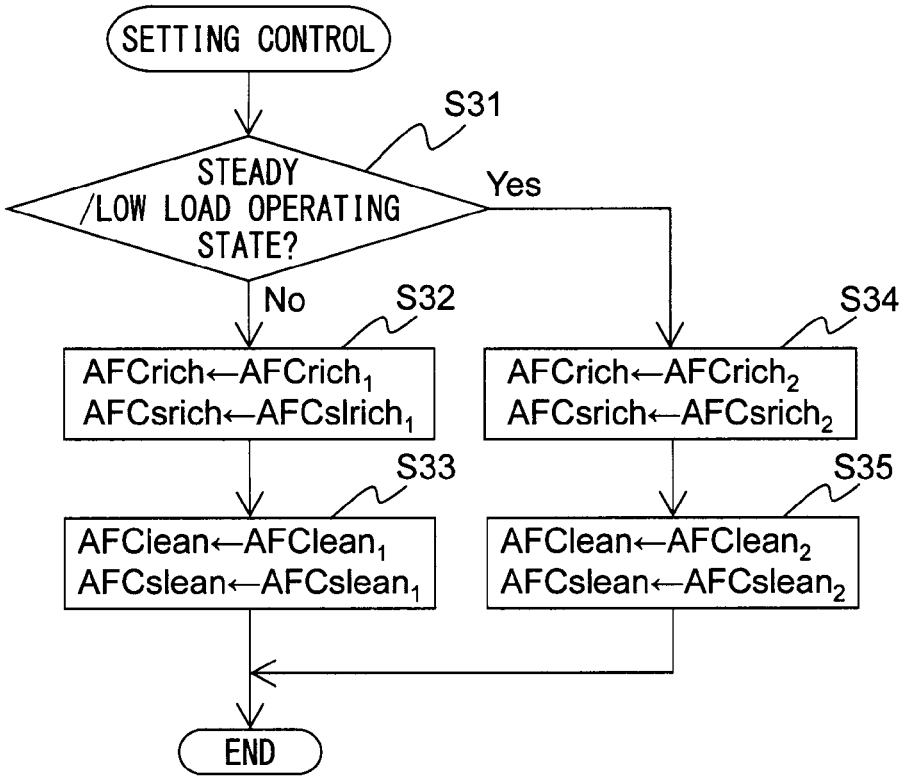
FIG. 9 is a flow chart which shows a control routine in control for setting a rich set air-fuel ratio and a lean set air-fuel ratio.

Next, referring to FIG. 7 to FIG. 9, the control system in the above embodiment will be specifically explained. The control system in the present embodiment is comprised of the functional blocks A1 to A7 in the functional block diagram of FIG. 7. Below, the functional blocks will be explained while referring to FIG. 7. The operations at these functional blocks A1 to A7 are basically performed in the ECU 31.

<Calculation of Fuel Injection Amount>

First, the calculation of the fuel injection amount will be explained. In calculating the fuel injection amount, the cylinder intake air amount calculating means A1, basic fuel injection amount calculating means A2, and fuel injection amount calculating means A3 are used.

The cylinder intake air amount calculating means A1 calculates the amount of intake air MC to the cylinders based on the amount of flow Ga of intake air, engine speed NE, and map or calculation formula which is stored in the ROM 34 of the ECU 31. The amount of flow of intake air Ga is measured by the air flow meter 39, while the engine speed NE is calculated based on the output of the crank angle sensor 44.

The basic fuel injection amount calculating means A2 divides the cylinder intake air amount Mc, which was calculated by the cylinder intake air amount calculating means A1, by the target air-fuel ratio AFT, to thereby calculate the basic fuel injection amount Qbase (Qbase=Mc/AFT). The target air-fuel ratio AFT is calculated by the later explained target air-fuel ratio setting means A5.

The fuel injection amount calculating means A3 adds the basic fuel injection amount Qbase, which was calculated by the basic fuel injection amount calculating means A2, and the later explained F/B correction amount DFi, to thereby calculate the fuel injection amount Qi (Qi=Qbase+DFi). The fuel injector 11 is instructed to inject fuel so that the thus calculated fuel injection amount Qi of fuel is injected from the fuel injector 11.

<Calculation of Target Air-Fuel Ratio>

Next, the calculation of the target air-fuel ratio will be explained. In calculating the target air-fuel ratio, the air-fuel ratio correction amount calculating means A4 and the target air-fuel ratio setting means A5 are used.

In the air-fuel ratio correction amount calculating means A4, the air-fuel ratio correction amount AFC of the target air-fuel ratio is calculated based on the output air-fuel ratio AFdwn of the downstream side air-fuel ratio sensor 41. Specifically, the air-fuel ratio correction amount AFC is calculated based on the flow chart shown in FIG. 8 or FIG. 9.

The target air-fuel ratio setting means A5 calculates the target air-fuel ratio AFT by adding the control center air-fuel ratio (in the present embodiment, the stoichiometric air-fuel ratio) AFR and the air-fuel ratio correction amount AFC which was calculated by the air-fuel ratio correction amount calculating means A4. The thus calculated target air-fuel ratio AFT is input to the basic fuel injection amount calculating means A2 and the later explained air-fuel ratio deviation calculating means A6.

<Calculation of F/B Correction Amount>

Next, the calculation of the F/B correction amount based on the output air-fuel ratio AFup of the upstream side air-fuel ratio sensor 40 will be explained. In calculating the F/B correction amount, the air-fuel ratio deviation calculating means A6 and the F/B correction amount calculating means A7 are used.

The air-fuel ratio deviation calculating means A6 subtracts, from the output air-fuel ratio AFup of the upstream side air-fuel ratio sensor 40, the target air-fuel ratio AFT which was calculated by the target air-fuel ratio setting means A5 to thereby calculate the air-fuel ratio deviation DAF (DAF=AFup−AFT). This air-fuel ratio deviation DAF is a value which expresses the excess/deficiency of the amount of feed of fuel with respect to the target air-fuel ratio AFT.

The F/B correction amount calculating means A7 processes the air-fuel ratio deviation DAF, which was calculated by the air-fuel ratio deviation calculating means A6, by proportional-integral-derivative processing (PID processing) so as to calculate the F/B correction amount DFi for compensating for the excess/deficiency of the amount of fuel feed, based on the following formula (2). The thus calculated F/B correction amount DFi is input to the fuel injection amount calculating means A3.

$$DFi=Kp\cdot DAF+Ki\cdot SDAF+Kd\cdot DDAF \quad (2)$$

Note that, in the above formula (2), Kp is a preset proportional gain (proportional constant), Ki is a preset integral gain (integral constant), and Kd is a preset derivative gain (derivative constant). Further, DDAF is a time derivative value of the air-fuel ratio deviation DAF and is calculated by dividing the difference between the currently updated air-fuel ratio deviation DAF and the previously updated air-fuel ratio deviation DAF by the time corresponding to the updating interval. Further, SDAF is a time integral value of the air-fuel ratio deviation DAF. This time integral value DDAF is calculated by adding the previously updated time integral value DDAF and the currently updated air-fuel ratio deviation DAF (SDAF=DDAF+DAF).

<Flow Chart>

FIG. 8 is a flow chart which shows the control routine in control for calculation of the air-fuel ratio correction amount. The illustrated control routine is performed by interruption at fixed time intervals.

As shown in FIG. 8, first, at step S11, it is judged if the condition for calculation of the air-fuel ratio correction amount AFC stands. The case where the condition for calculation of the air-fuel ratio correction amount AFC stands means, for example, during normal control, for example, not during fuel cut control, etc. When it is judged at step S11 that the condition for calculation of the air-fuel ratio correction amount AFC stands, the routine proceeds to step S12.

At step S12, it is judged if the lean set flag F1 is set to OFF. The lean set flag F1 is a flag which is set to ON when the target air-fuel ratio is set to the lean air-fuel ratio, that is, when the air-fuel ratio correction amount AFC is set to 0 or more, and is set to OFF otherwise. When it is judged at step S12 that the lean set flag F1 is set to OFF, the routine proceeds to step S13. At step S13, it is judged if the output air-fuel ratio AFdwn of the downstream side air-fuel ratio sensor 41 is the rich judged air-fuel ratio AFrich or less.

When, at step S13, it is judged that the output air-fuel ratio AFdwn of the downstream side air-fuel ratio sensor 41 is larger than the rich judged air-fuel ratio AFrich, the routine proceeds to step S14. At step S14, it is judged if the output air-fuel ratio AFdwn of the downstream side air-fuel ratio sensor 41 is smaller than the lean judged air-fuel ratio AFlean. When it is judged that the output air-fuel ratio AFdwn is the lean judged air-fuel ratio AFlean or more, the routine proceeds to step S15. At step S15, the air-fuel ratio correction amount AFC is set to the rich set correction amount AFCrich and the control routine is ended.

After that, if the output air-fuel ratio AFdwn of the downstream side air-fuel ratio sensor 41 approaches the stoichiometric air-fuel ratio and becomes smaller than the lean judged air-fuel ratio AFlean, at the next control routine, the routine proceeds from step S14 to step S16. At step S16, the air-fuel ratio correction amount AFC is set to the weak rich set correction amount AFCsrich and the control routine is ended.

Then, if the oxygen storage amount OSA of the upstream side exhaust purification catalyst 20 becomes substantially zero and the output air-fuel ratio AFdwn of the downstream side air-fuel ratio sensor 41 becomes the rich judged air-fuel ratio AFrich or less, at the next control routine, the routine proceeds from step S13 to step S17. At step S17, the air-fuel ratio correction amount AFC is set to the lean set correction amount AFClean. Next, at step S18, the lean set flag F1 is set to ON and the control routine is ended.

If the lean set flag F1 is set to ON, at the next control routine, the routine proceeds from step S12 to step S19. At step S19, it is judged if the output air-fuel ratio AFdwn of the downstream side air-fuel ratio sensor 41 is the lean judged air-fuel ratio AFlean or more.

When it is judged at step S19 that the output air-fuel ratio AFdwn of the downstream side air-fuel ratio sensor 41 is smaller than the lean judged air-fuel ratio AFlean, the routine proceeds to step S20. At step S20, it is judged if the output air-fuel ratio AFdwn of the downstream side air-fuel ratio sensor 41 is larger than the rich judged air-fuel ratio AFrich. If it is judged that the output air-fuel ratio AFdwn is the rich judged air-fuel ratio AFrich or less, the routine proceeds to step S21. At step S21, the air-fuel ratio correction amount AFC is continued to be set to the lean set correction amount AFClean and the control routine is ended.

After that, if the output air-fuel ratio AFdwn of the downstream side air-fuel ratio sensor 41 approaches the stoichiometric air-fuel ratio and becomes larger than the rich judged air-fuel ratio AFrich, at the next control routine, the routine proceeds from step S20 to step S22. At step S22, the air-fuel ratio correction amount AFC is set to the weak lean set air-fuel ratio AFCslean and the control routine is ended.

After that, if the oxygen storage amount OSA of the upstream side exhaust purification catalyst 20 becomes the substantially maximum storable oxygen amount and the output air-fuel ratio AFdwn of the downstream side air-fuel ratio sensor 41 becomes the lean judged air-fuel ratio AFlean or more, at the next control routine, the routine proceeds from step S19 to step S23. At step S23, the air-fuel ratio correction amount AFC is set to the rich set correction amount AFCrich. Next, at step S24, the lean set flag F1 is reset to OFF and the control routine is ended.

FIG. 9 is a flow chart which shows a control routine in control for setting the rich set air-fuel ratio and lean set air-fuel ratio. The illustrated control routine is performed by interruption at fixed time intervals.

First, at step S31, it is judged if the engine operating state is the steady operation state and is an engine low load operation state. Specifically, for example, when the amount of change per unit time of the engine load of the internal combustion engine which is detected by the load sensor 43 is a predetermined amount of change or less or when the amount of change per unit time of the amount of intake air of the internal combustion engine which is detected by the air flow meter 39 is a predetermined amount of change or less, it is judged that the engine operating state is the steady operation state, while otherwise, it is judged that the engine operating state is in a transitory operation state (not steady operation state).

When, at step S31, it is judged that the engine operating state is not the steady operation state or is in the medium and high load operation state, the routine proceeds to step S32. At step S32, the rich set correction amount AFCrich is set to the normal rich set correction amount $AFCrich_1$. Therefore, at steps S15 and S23 in the flow chart shown in FIG. 8, the air-fuel ratio correction amount AFC is set to the normal rich set correction amount $AFCrich_1$. In addition, at step S32, the weak rich set correction amount AFCsrich is set to the normal weak rich set correction amount $AFCsrich_1$. Therefore, at step S16 in the flow chart shown in FIG. 8, the air-fuel ratio correction amount AFC is set to the normal rich set correction amount $AFCrich_1$.

Next, at step S33, the lean set correction amount AFClean is set to the normal lean set correction amount $AFClean_1$. Therefore, at steps S17 and S21 of the flow chart shown in FIG. 8, the air-fuel ratio correction amount AFC is set to the normal lean set correction amount $AFClean_1$. In addition, at step S33, the weak lean set correction amount AFCslean is set to the normal weak rich set correction amount $AFCslean_1$. Therefore, at step S22 of the flow chart shown in FIG. 8, the air-fuel ratio correction amount AFC is set to the normal lean set correction amount $AFClean_1$.

On the other hand, when, at step S31, it is judged that the engine operating state is the steady operation state and engine low load operation state, the routine proceeds to step S34. At step S34, the rich set correction amount AFCrich is set to the increased rich set correction amount $AFCrich_2$. In addition, the weak rich set correction amount AFCsrich is set to the increased weak rich set correction amount $AFCsrich_2$. Next, at step S35, the lean set correction amount AFClean is set to the increased lean set correction amount $AFClean_2$. In addition, the weak lean set correction amount AFCslean is set to the increased weak rich set correction amount $AFCslean_2$.

Other Embodiments

In the above embodiment, when the engine operating state is a steady operation state and is a low load operation state, compared with when the engine operating state is not a steady operation state and is a medium and high load operation state, the absolute values of all of the lean set correction amount AFClean, weak lean set correction amount AFCslean, rich set correction amount AFCrich, and weak rich set correction amount AFCsrich are increased. However, there is no need to increase all of these absolute values. It is also possible to increase the absolute value of at least one set correction amount.

Figure 10:
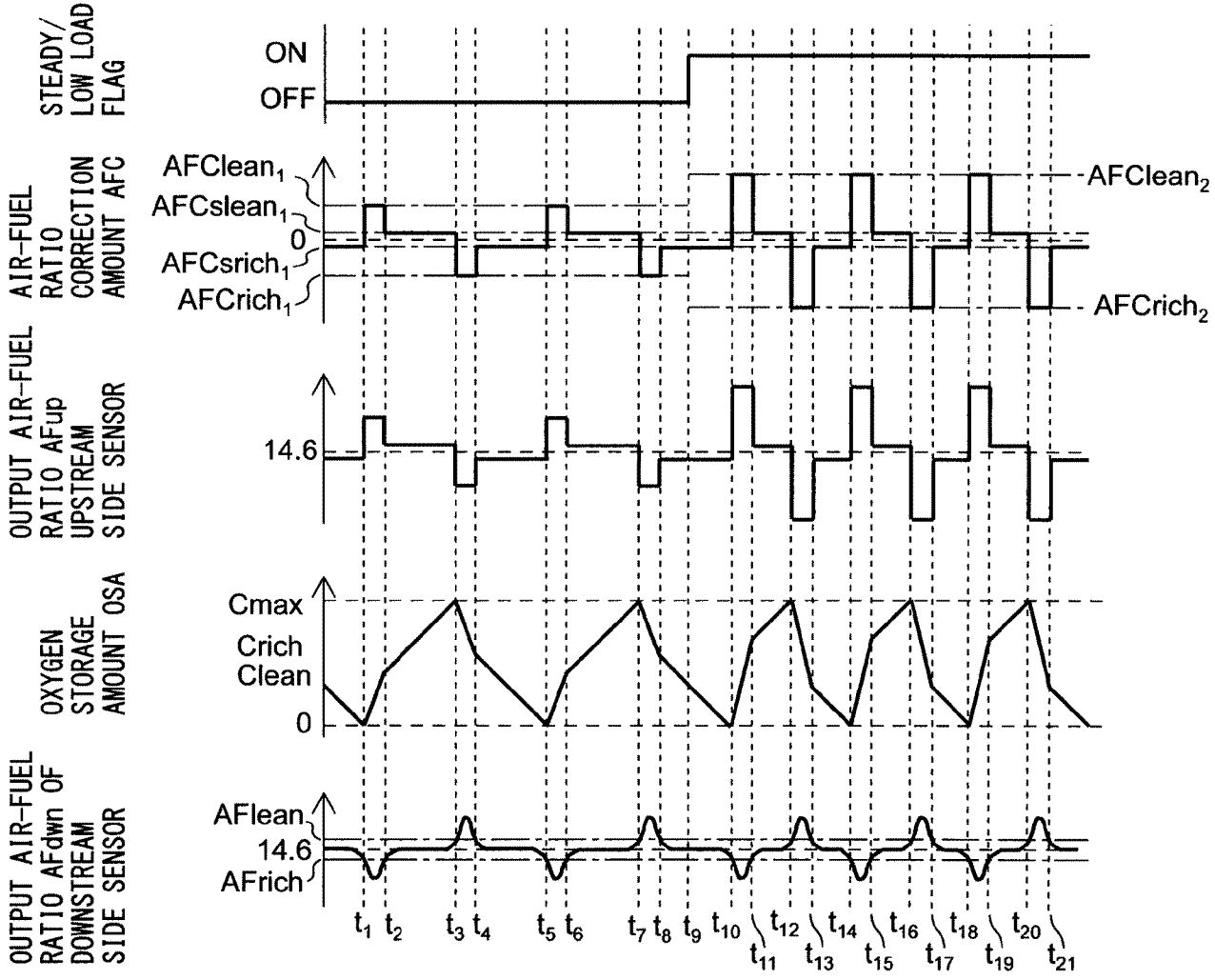
FIG. 10 is a time chart of an air-fuel ratio correction amount, etc., when performing control for setting different set air-fuel ratios.

Therefore, for example, as shown in FIG. 10, when the engine operating state is a steady operation state and is a low load operation state, compared with the case where the engine operating state is not a steady operation state and is a medium and high load operation state, only the lean set correction amount and rich set correction amount may be increased and the weak lean set correction amount and weak rich set correction amount may be maintained as they are. Due to this, for example, at the time $t_{10}$ or the time $t_{12}$, even if $NO_X$ or unburned gas flows out from the upstream side exhaust purification catalyst 20, the amount can be kept small.

Further, in the above embodiment, as the basic air-fuel ratio control, control is performed so that in the middle of the period when the target air-fuel ratio is set to the rich air-fuel ratio, the rich degree is decreased and so that in the middle of the period when the target air-fuel ratio is set to the lean air-fuel ratio, the lean degree is decreased. However, it is not necessary to use this air-fuel ratio control as the basic air-fuel ratio control. It is also possible to perform control so that when the target air-fuel ratio is set to the rich air-fuel ratio, the target air-fuel ratio is maintained at a certain fixed rich air-fuel ratio and so that when the target air-fuel ratio is set to the lean air-fuel ratio, the target air-fuel ratio is maintained at a certain fixed lean air-fuel ratio.

Furthermore, as explained above, for example, during the times $t_2$ to $t_3$, the times $t_3$ to $t_5$, etc. of FIG. 5, the air-fuel ratio correction amount AFC need not be maintained at a fixed value during these periods. When, in this way, the air-fuel ratio correction amount AFC is not maintained constant in these periods, the average value of the air-fuel ratio correction amount AFC in these periods is changed between when the engine operating state is a steady operation state and low load operation state and when the engine operating state is not a steady operation state and is a medium and high load operation state.

Therefore, expressing these together, in the embodiments of the present invention, if the engine operating state is a steady operation state and is a low load operation state, compared with when the engine operating state is not the steady operation state and is the medium and high load operation state, it can be said that at least one of the average lean degree of the target air-fuel ratio while the target air-fuel ratio is set to the lean air-fuel ratio and the average rich degree of the target air-fuel ratio while the target air-fuel ratio is set to the rich air-fuel ratio is increased.

Alternatively, if changing the perspective, in the embodiments of the present invention, when the engine operating state is the steady operation state and is the low load operation state, compared with when the engine operating state is not the steady operation state and is the medium and high load operation state, it can be said that at least one of the maximum value of the lean degree of the target air-fuel ratio while the target air-fuel ratio is set to the lean air-fuel ratio and the maximum value of the rich degree of the target air-fuel ratio while the target air-fuel ratio is set to the rich air-fuel ratio is increased.

REFERENCE SIGNS LIST

1. engine body
5. combustion chamber
7. intake port
9. exhaust port
19. exhaust manifold
20. upstream side exhaust purification catalyst
24. downstream side exhaust purification catalyst
31. ECU
40. upstream side air-fuel ratio sensor
41. downstream side air-fuel ratio sensor

The invention claimed is:

1. A control system of an internal combustion engine, the engine comprising an exhaust purification catalyst which is arranged in an exhaust passage of the internal combustion engine and which can store oxygen, the control system comprising:

a downstream side air-fuel ratio sensor which is arranged at a downstream side of said exhaust purification catalyst in a direction of exhaust flow and which detects an air-fuel ratio of the exhaust gas flowing out from said exhaust purification catalyst; and an electronic control unit which controls the air-fuel ratio of the exhaust gas so that the air-fuel ratio of the exhaust gas flowing into said exhaust purification catalyst becomes a target air-fuel ratio, wherein the electronic control unit is configured to set said target air-fuel ratio to a lean air-fuel ratio which is leaner than a stoichiometric air-fuel ratio when an exhaust air-fuel ratio which is detected by said downstream side air-fuel ratio sensor becomes a rich judged air-fuel ratio, which is richer than the stoichiometric air-fuel ratio, and set said target air-fuel ratio to a rich air-fuel ratio which is richer than a stoichiometric air-fuel ratio when an exhaust air-fuel ratio which is detected by said downstream side air-fuel ratio sensor becomes a lean judged air-fuel ratio, which is leaner than the stoichiometric air-fuel ratio, and, when an engine operating state is a steady operation state and is a low load operation state, compared with when the engine operating state is not a steady operation state and is a medium and high load operation state, increase at least one of an average lean degree of said target air-fuel ratio while said target air-fuel ratio is set to a lean air-fuel ratio, and an average rich degree of said target air-fuel ratio while said target air-fuel ratio is set to a rich air-fuel ratio.

2. The control system of an internal combustion engine according to claim 1, wherein the electronic control unit is configured to, when the engine operating state is a steady operation state and is a low load operation state, compared with when the engine operating state is not a steady operation state and is a medium and high load operation state, increase at least one of a maximum value of a lean degree of said target air-fuel ratio while said target air-fuel ratio is set to a lean air-fuel ratio, and a maximum value of a rich degree of said target air-fuel ratio while said target air-fuel ratio is set to a rich air-fuel ratio.

3. The control system of an internal combustion engine according to claim 1, wherein the electronic control unit is configured to switch said target air-fuel ratio to a lean set air-fuel ratio which is leaner than the target air-fuel ratio when an exhaust air-fuel ratio detected by said downstream side air-fuel ratio sensor becomes a rich judged air-fuel ratio or less, set said target air-fuel ratio to a lean air-fuel ratio with a lean degree smaller than said lean set air-fuel ratio from a lean degree change timing after said target air-fuel ratio is set to said lean set air-fuel ratio and before the exhaust air-fuel ratio detected by said downstream side air-fuel ratio sensor becomes the lean judged air-fuel ratio or more, until the exhaust air-fuel ratio detected by said downstream side air-fuel ratio sensor becomes the lean judged air-fuel ratio or more, switch said target air-fuel ratio to a rich set air-fuel ratio which is richer than the stoichiometric air-fuel ratio when the exhaust air-fuel ratio detected by said downstream side air-fuel ratio sensor becomes the lean judged air-fuel ratio or more, and set said target air-fuel ratio to a rich air-fuel ratio with a rich degree smaller than said rich set air-fuel ratio from a rich degree change timing after said target air-fuel ratio is set to said rich set air-fuel ratio and before the exhaust air-fuel ratio detected by said downstream side air-fuel ratio sensor becomes the rich judged air-fuel ratio or less, until the exhaust air-fuel ratio detected by said downstream side air-fuel ratio sensor becomes the rich judged air-fuel ratio or less.

4. The control system of an internal combustion engine according to claim 3, wherein the electronic control unit is configured to increase at least one of a lean degree of said lean set air-fuel ratio and a rich degree of said rich set air-fuel ratio when the engine operating state is a steady operation state and is a low load operation state, compared with when the engine operating state is not a steady operation state and is a medium and high load operation state, and increase at least one of an average rich degree of said target air-fuel ratio after said rich degree change timing and an average lean degree of said target air-fuel ratio after said lean degree change timing when the engine operating state is a steady operation state and is a low load operation state, compared with when the engine operating state is not a steady operation state and is a medium and high load operation state.

5. The control system of an internal combustion engine according to claim 3, wherein the electronic control unit is configured to increase at least one of a lean degree of said lean set air-fuel ratio and a rich degree of said rich set air-fuel ratio when the engine operating state is a steady operation state and is a low load operation state, compared with when the engine operating state is not a steady operation state and is a medium and high load operation state, and maintain the average lean degree of said target air-fuel ratio after said rich degree change timing and the average rich degree of said target air-fuel ratio after said lean degree change timing between when the engine operating state is a steady operation state and is a low load operation state and when the engine operating state is not a steady operation state and is a medium and high load operation state.

* * * * *